US012258957B2

(12) United States Patent
Song et al.

(10) Patent No.: US 12,258,957 B2
(45) Date of Patent: Mar. 25, 2025

(54) LINEAR COMPRESSOR

(71) Applicant: LG Electronics Inc., Seoul (KR)

(72) Inventors: Sangjin Song, Seoul (KR); Junghae Kim, Seoul (KR); Chulgi Roh, Seoul (KR)

(73) Assignee: LG Electronics Inc., Seoul (KR)

( * ) Notice: Subject to any disclaimer, the term of this patent is extended or adjusted under 35 U.S.C. 154(b) by 750 days.

(21) Appl. No.: 17/358,302

(22) Filed: Jun. 25, 2021

(65) Prior Publication Data

US 2022/0018344 A1 Jan. 20, 2022

(30) Foreign Application Priority Data

Jul. 20, 2020 (KR) ..... 10-2020-0089792

(51) Int. Cl.
*F04B 53/14* (2006.01)
*F04B 53/16* (2006.01)

(52) U.S. Cl.
CPC ..... *F04B 53/14* (2013.01); *F04B 53/16* (2013.01)

(58) Field of Classification Search
CPC ..... F04B 53/14; F04B 53/143; F04B 53/16; F04B 53/162; F04B 53/166; F04B 53/18
See application file for complete search history.

(56) References Cited

U.S. PATENT DOCUMENTS 2,085,976 A * 7/1937 Heintz ..... F02F 1/20 123/193.2
3,777,722 A 12/1973 Lenger
4,456,882 A 6/1984 Doty
8,381,696 B2 * 2/2013 Urabe ..... F16J 10/04 123/193.2
8,556,599 B2 * 10/2013 Lee ..... F04B 39/0238 184/32

(Continued)

FOREIGN PATENT DOCUMENTS

KR 19910004237 3/1991
KR 20130026881 3/2013

(Continued)

OTHER PUBLICATIONS

Extended European Search Report in European Appln. No. 21175914.7, dated Oct. 14, 2021, 8 pages.

(Continued)

*Primary Examiner* — Essama Omgba
*Assistant Examiner* — Charles W Nichols
(74) *Attorney, Agent, or Firm* — Fish & Richardson P.C.

(57) ABSTRACT

A linear compressor includes: a piston configured to reciprocate in an axial direction, and a cylinder that is provided on a radially outer side of the piston to accommodate the piston and that defines a compression space with the piston. The cylinder includes: a gas hole defined at the cylinder such that a first end of the gas hole is at an outer circumferential surface of the cylinder and a second end of the gas hole is at an inner circumferential surface of the cylinder, and a gas pocket that is in communication with the gas hole and that is recessed from the inner circumferential surface of the cylinder, where a length of the gas pocket in the axial direction of the cylinder is longer than a length of the gas pocket in a circumferential direction of the cylinder.

3 Claims, 11 Drawing Sheets

(56) References Cited

U.S. PATENT DOCUMENTS

| | | | | |
|---|---|---|---|---|
| 2014/0182540 | A1* | 7/2014 | Johansson | F02F 1/004<br>123/193.2 |
| 2015/0369225 | A1* | 12/2015 | Ha | F04B 39/122<br>417/443 |
| 2017/0314542 | A1 | 11/2017 | Ha et al. | |
| 2020/0149518 | A1 | 5/2020 | Jeon et al. | |

FOREIGN PATENT DOCUMENTS

| | | |
|---|---|---|
| KR | 101332556 | 11/2013 |
| KR | 1020150040027 | 4/2015 |
| KR | 20160000322 | 1/2016 |
| KR | 20160000403 | 1/2016 |
| KR | 1020200004133 | 1/2020 |
| KR | 102140807 | 8/2020 |

OTHER PUBLICATIONS

Notice of Allowance in Korean Appln. No. 10-2020-0089792, dated Jan. 20, 2022, 4 pages (with English translation).

* cited by examiner

LINEAR COMPRESSOR

CROSS-REFERENCE TO RELATED APPLICATION

Pursuant to 35 U.S.C. § 119(a), this application claims the benefit of the earlier filing date and the right of priority to Korean Patent Application No. 10-2020-0089792, filed on Jul. 20, 2020, the contents of which is incorporated by reference herein in its entirety.

TECHNICAL FIELD

The present disclosure relates to a linear compressor, and more particularly, a gas bearing.

BACKGROUND

A linear compressor, including a linear motor installed inside a sealed shell, and a piston connected to the linear motor, performs sucking, compressing, and discharging refrigerant while the piston is linearly reciprocating inside a cylinder.

Further, as the piston reciprocates inside the cylinder of such linear compressor, a bearing surface between an inner circumferential surface of the cylinder and an outer circumferential surface of the piston should be lubricated. For example, a conventional oil bearing method discloses filling a predetermined amount of oil in an inner space of a shell and then pumping the oil to be supplied to a bearing surface.

However, for a conventional compressor using the conventional oil bearing method, a volume of the shell is increased that results increasing a size of the conventional compressor. In addition, when oil is discharged into a refrigeration cycle together with refrigerant, friction loss may be caused by insufficient oil inside the compressor.

With this reason, a conventional gas bearing method in which high pressured gas discharged from a compression space is supplied to a bearing surface to help a piston float against a cylinder by a pressure of the discharged refrigerant was introduced.

For a conventional compressor using the conventional gas bearing method, the cylinder is provided with a gas bearing to supply high pressured gas (hereinafter, high-pressure gas) to the bearing surface between the cylinder and the piston. For example. the cylinder is provided with a gas hole penetrating from an outer circumferential surface to an inner circumferential surface of the cylinder, and a gas pocket formed on the inner circumferential surface of the cylinder to receive high-pressure gas introduced thereinto through the gas hole that is communicated with the gas pocket. The gas hole is formed narrow so that an appropriate amount of high-pressure gas is introduced into the bearing surface, and a cross-sectional area of the gas pocket is greater than a cross-sectional area of the gas hole in order to secure an effective area of the gas bearing.

SUMMARY

The present disclosure is directed to a linear compressor capable of increasing a levitation force of a gas bearing against a piston.

In addition, the present disclosure is directed to a linear compressor capable of minimizing leakage of high-pressure gas in which high-pressure gas in a gas pocket provided on an inner circumferential surface of a cylinder and forming a part of a gas bearing is leaked between the cylinder and a piston.

In addition, the present disclosure is directed to a linear compressor capable of suppressing damage to an outer circumferential surface of a piston while increasing a levitation force of a gas bearing.

In addition, the present disclosure is directed to a linear compressor that suppresses damage to a piston by reducing an orthogonal area between the piston and a gas pocket during a reciprocating movement of the piston.

According to one aspect of the subject matter described in this application, a linear compressor includes a piston configured to reciprocate in an axial direction, and a cylinder that is provided on a radially outer side of the piston to accommodate the piston and that defines a compression space with the piston. The cylinder can include a gas hole defined at the cylinder such that a first end of the gas hole is at an outer circumferential surface of the cylinder and a second end of the gas hole is at an inner circumferential surface of the cylinder, and a gas pocket that is in communication with the gas hole and that is recessed from the inner circumferential surface of the cylinder, where a length of the gas pocket in the axial direction of the cylinder is longer than a length of the gas pocket in a circumferential direction of the cylinder.

Implementations according to this aspect can include one or more of the following features. For example a depth of an edge of the gas pocket can be shallower than a depth of a central portion of the gas pocket.

In some implementations, a depth of an inner circumferential surface of the gas pocket can increase from an edge of the gas pocket to a central portion of the gas pocket. In some implementations, an inner circumferential surface of the gas pocket can have a circular or elliptically curved shape in a depthwise direction.

In some examples, an angle between an edge of the gas pocket and the inner circumferential surface of the cylinder can be an obtuse angle. In some examples, the gas pocket can have an elliptical shape in which a long axis of the gas pocket is in the axial direction and a short axis of the gas pocket is in a circumferential direction.

In some implementations, the gas pocket can have an axially long rectangular shape or a rectangular shape with rounded corners. In some implementations, the gas hole can be in communication with the gas pocket at a position axially spaced apart from a center of the gas pocket.

In some examples, the gas hole can be in communication with the gas pocket at a position that is spaced apart from a center of the gas pocket and that is closer to an axial end of the cylinder than to the center of the gas pocket. In some examples, the gas pocket can comprise a plurality of gas pockets that are spaced apart from each other at predetermined intervals in a circumferential direction of the cylinder, and each of the plurality of gas pockets can be in communication with a corresponding gas hole.

In some implementations, the gas pocket can include a first gas pocket provided at a first axial side of the cylinder with respect to a center of an axially extended line, and a second gas pocket provided at a second axial side of the cylinder with respect to the center of the axially extended line. At least one of the first gas pocket or the second gas pocket can be elongated in the axial direction. In some implementations, the gas pocket can include a first gas pocket provided at a first axial side of the cylinder with respect to a center of an axially extended line, and a second gas pocket provided at a second axial side of the cylinder with respect to the center of the axially extended line. The first gas pocket can be elongated in the axial direction, and the second gas pocket can be elongated in a circumferential direction, and a distance between the first gas pocket and the compression space can be shorter than a distance between the second gas pocket and the compression space.

In some examples, the gas pocket can include a plurality of first gas pockets provided at a first axial side of the cylinder with respect to a center of an axially extended line, and a plurality of second gas pockets provided at a second axial side of the cylinder with respect to the center of the axially extended line. Each of the plurality of first gas pockets and the plurality of second gas pockets can be disposed at equal intervals in a circumferential direction. In some examples, the gas pocket can include a first gas pocket provided at a first axial side of the cylinder with respect to a center of an axially extended line, and a second gas pocket provided at a second axial side of the cylinder with respect to the center of the axially extended line. The first gas pocket and the second gas pocket can be disposed at different positions in the axial direction.

In some implementations, the gas pocket can include a plurality of first gas pockets provided at a first axial side of the cylinder with respect to a center of an axially extended line, and a plurality of second gas pockets provided at a second axial side of the cylinder with respect to the center of the axially extended line. The plurality of first gas pockets and the plurality of second gas pockets can be alternately disposed in a circumferential direction of the cylinder.

According to another aspect of the subject matter described in this application, a linear compressor includes a piston configured to reciprocate in an axial direction of the cylinder, and a cylinder that is provided on a radially outer side of the piston to accommodate the piston and that defines a compression space with the piston. The cylinder can be provided with a gas pocket that is recessed from an inner circumferential surface of the cylinder and that has an elliptical outline.

Implementations according to this aspect can include one or more following features. For example, a depth of an inner circumferential surface of the gas pocket can increase from an edge of the gas pocket to a central portion of the gas pocket.

In some implementations, the gas pocket can include a first gas pocket provided at a first axial side of the cylinder with respect to a center of an axially extended line, and a second gas pocket provided at a second axial side of the cylinder with respect to the center of the axially extended line. At least one of the first gas pocket or the second gas pocket cab be elongated in the axial direction of the cylinder.

In some implementations, the cylinder can define a gas hole such that a first end of the gas hole is at an outer circumferential surface of the cylinder and a second end of the gas hole is at an inner circumferential surface of the cylinder. In some examples, the gas pocket can include a plurality of gas pockets that are spaced apart from each other at predetermined intervals in a circumferential direction of the cylinder, and each of the plurality of gas pockets can be in communication with a corresponding gas hole such that a first end of the corresponding gas hole is at an outer circumferential surface of the cylinder and a second end of the corresponding gas hole is at an inner circumferential surface of the cylinder.

DETAILED DESCRIPTION

Figure 1:
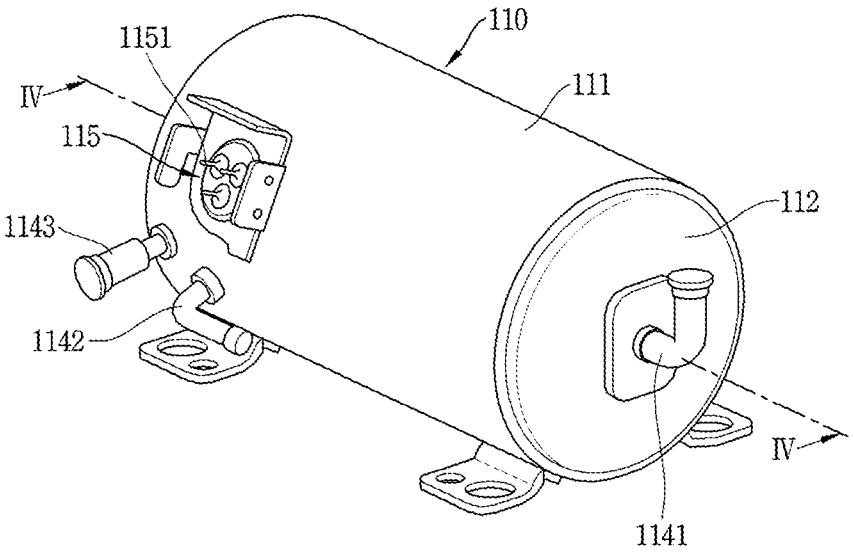
FIG. 1 is a diagram illustrating an appearance of a linear compressor.
Figure 2:
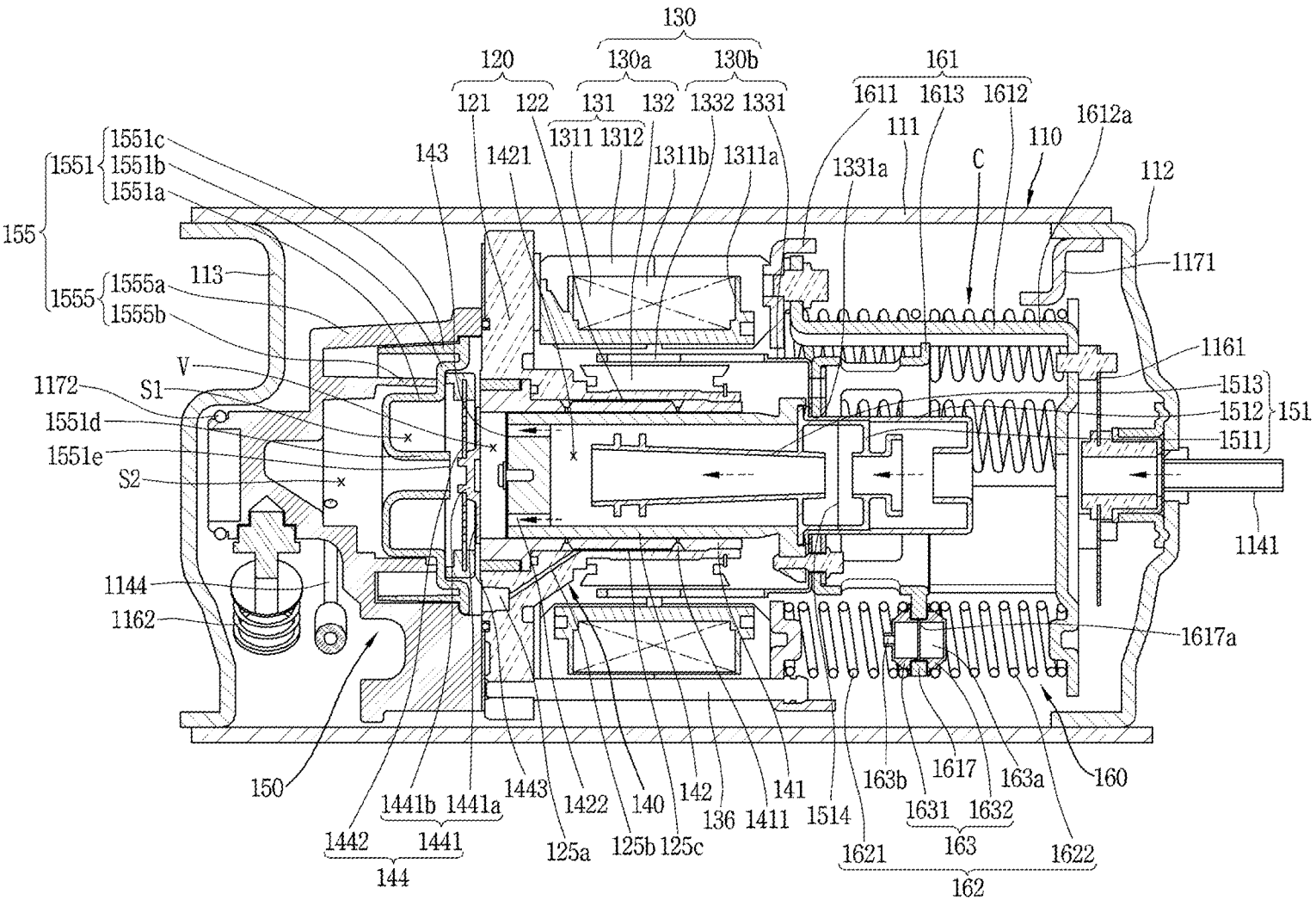
FIG. 2 is a diagram illustrating a cross-sectional view taken along a line IV-IV of FIG. 1.

FIG. 1 is a diagram illustrating an appearance of a linear compressor, and FIG. 2 is a diagram illustrating a cross-sectional view taken along a line IV-IV of FIG. 1.

Referring to FIGS. 1 and 2, the linear compressor can include a compressor body C in which a piston 142, which is provided inside a shell 110 and coupled to a mover 130*b* of a linear motor, performs sucking, compressing, and discharging refrigerant while reciprocating inside a cylinder 141.

The shell 110 can include a cylindrical shell 111 defined in a cylindrical shape, and a pair of shell covers 112 and 113 coupled to opposite end portions of the cylindrical shell 111. The pair of shell covers 112 and 113 can include a first shell cover 112 at a rear refrigerant suction side and a second shell cover 113 at a front refrigerant discharge side.

The cylindrical shell 111 can be defined in a cylindrical shape extending in a lateral direction. In some implementations, the cylindrical shell 111 can be defined in a cylindrical shape extending in a lengthwise direction. A description will be given focusing on an example in which the cylindrical shell 111 is extended in the lateral direction. Accordingly, a central axis of the cylindrical shell 111 in a lengthwise direction corresponds to a central axis of the compressor body C, to be described later, and the central axis of the compressor body C corresponds to central axes of the piston 142 and the cylinder 141 composing the compressor body C.

The cylindrical shell 111 can have various inner diameters depending on a size of a motor unit 130. In some implementations, when an oil bearing is excluded and a gas bearing is applied, there is no need to fill an inner space of the shell 110 with oil. Therefore, an inner diameter of the cylindrical shell 111 can be formed as small as possible with a sufficient size to avoid contact between a frame head portion 121 of a frame 120 and an inner circumferential surface of the shell 110. Accordingly, in the linear compressor, an outer diameter of the cylindrical shell 111 can be formed small.

Opposite ends of the cylindrical shell 111 can be opened, and the first shell cover 112 and the second shell cover 113 described above can be respectively coupled to each end of the cylindrical shell 111. The first shell cover 112 can be coupled to seal a right opening end, which is a rear side of the cylindrical shell 111, and the second shell cover 113 can be coupled to seal a left opening end, which is a front side of the cylindrical shell 111.

Accordingly, the inner space of the shell 110 can be sealed. The first shell cover 112 can be provided with a refrigerant suction pipe 1141 configured to guide refrigerant to the inner space of the shell 110 coupled therethrough. The cylindrical shell 111 can be provided with a refrigerant discharge pipe 1142 configured to guide compressed refrigerant to the refrigeration cycle, and a refrigerant injection pipe 1143 configured to replenish refrigerant, respectively coupled therethrough.

A front side surface of the cylindrical shell 111 can be provided with a terminal bracket 115, and the terminal bracket 115 can be provided with a terminal 1151 formed through the cylindrical shell 111 and configured to transmit external power to the linear motor.

Referring to FIG. 2, the compressor body C can be provided inside the cylindrical shell 111, and a rear support spring (hereinafter, a first support spring) 1161 and a front support spring (hereinafter, a second support spring) 1162 each supporting the compressor body C can be installed at a rear side and a front side of the compressor body C, respectively.

The first support spring 1161 can be implemented as a leaf spring provided between a rear surface of a rear cover 1612 and the first shell cover 112 facing the same, and the second support spring 1162 can be implemented as a compressed coil spring provided between an outer circumferential surface of a cover housing 1555 and an inner circumferential surface of the cylindrical shell 111 facing the same.

In some implementations, stoppers 1171 and 1172 to lock the compressor body C with respect to the shell 110 can be installed inside the shell 110. The stoppers 1171 and 1172 can include a first stopper 1171 to lock the rear side of the compressor body C and a second stopper 1172 to lock the front side of the compressor body C.

The first stopper 1171 can be implemented as a bracket installed at the inner circumferential surface of the cylindrical shell 111 to correspond to the rear cover 1612, and the second stopper 1172 can be implemented as a ring installed at the outer circumferential surface of the cover housing 1555 to correspond to an inner surface of the second shell cover 113.

The first stopper 1171 can lock the compressor body C in the axial direction (front-rear direction, and lateral direction), and the second stopper 1172 can lock the compressor body C in a radial direction. Accordingly, breakage of the compressor body due to collision with the shell 110 caused by shaking, vibration, or impact occurred during transportation of the compressor can be limited.

Referring to FIG. 2, the compressor body C can include the frame 120, a motor unit 130 implemented as a linear motor, a compression unit 140, a suction and discharge unit 150, and a resonance unit 160. Front sides of the motor unit 130 and the compression unit 140 can be fixed to the frame 120, and the motor unit 130 and the compression unit 140 can be elastically supported by the resonance unit 160.

The frame 120 can include the frame head portion 121 and a frame body portion 122. The frame head portion 121 can be defined in a disk shape, and the frame body portion 122 can be defined in a cylindrical shape extending from a rear surface of the frame head portion 121.

The rear surface of the frame head portion 121 can be provided with an outer stator 131 coupled thereto, and a front surface of the frame head portion 121 can be provided with a discharge cover assembly 146 coupled thereto. An outer circumferential surface of the frame body portion 122 can be provided with an inner stator 132 coupled thereto, and an inner circumferential surface of the frame body portion 122 can be provided with the cylinder 141 coupled thereto.

The frame 120 can include a gas bearing passage portion forming a bearing inlet groove 125*a*, a bearing communication hole 125*b*, and a bearing communication groove 125*c*.

The bearing inlet groove 125*a* can be formed at one side of the front surface of the frame head portion 121, the bearing communication hole 125*b* can penetrate from a rear surface of the bearing inlet groove 125*a* to the inner circumferential surface of the frame body portion 122, and the bearing communication groove 125*c* can be formed on the inner circumferential surface of the frame body portion 122 to communicate with the bearing communication hole 125*b*.

For example, the bearing inlet groove 125*a* can be recessed in the axial direction by a predetermined depth from the front surface of the frame head portion 121, and the bearing communication hole 125*b* with a cross-sectional area smaller than the bearing inlet groove 125*a* can be inclined toward the inner circumferential surface of the frame body portion 122.

The bearing communication groove 125*c* can be defined in an annular shape having a predetermined depth and a predetermined axial length on the inner circumferential surface of the frame body portion 122. In some implementations, the bearing communication groove 125*c* can be formed on an outer circumferential surface of the cylinder 141 which is in contact with the inner circumferential surface of the frame body portion 122, or a half of the bearing communication groove 125*c* can be formed on the inner circumferential surface of the frame body portion 122 and another half of the bearing communication groove 125*c* can be formed on the outer circumferential surface of the cylinder 141.

In addition, a gas bearing 1411 communicating with the bearing communication groove 125*c* can be provided in the cylinder 141 corresponding to the bearing communication groove 125*c*.

Referring to FIG. 2, the motor unit 130 can include a stator 130*a* and a mover 130*b* reciprocating with respect to the stator 130*a*.

The stator 130*a* can include the outer stator 131 and the inner stator 132. The outer stator 131 can be fixed to the frame head portion 121 while surrounding the frame body portion 122 of the frame 120, and the inner stator 132 can be disposed inside the outer stator 131 with being spaced apart from the outer stator 131 by a predetermined gap.

The outer stator 131 can include a coil winding body 1311 and an outer stator core 1312. The coil winding body 1311 can be accommodated in the outer stator core 1312. In some implementations, the coil winding body 1311 can be accommodated in the inner stator 132.

The coil winding body 1311 can include a bobbin 1311*a* defined in an annular shape and a coil 1311*b* wound in a circumferential direction of the bobbin 1311*a*. The bobbin

1311*a* can be provided with a terminal portion to guide a power line drawn out from the coil 1311*b* to be drawn out or exposed outwardly of the outer stator 131.

The outer stator core 1312 can include a plurality of core blocks stacked in a circumferential direction of the bobbin 1311*a* so as to surround the coil winding body 1311. In some implementations, a plurality of lamination sheets each defined in a 'U' shape can be stacked to form the core block.

A rear side of the outer stator 131 can be provided with a stator cover 1611 to fix the outer stator 131 thereon. For example, a front surface of the outer stator 131 can be supported by the frame head portion 121, and a rear surface of the outer stator 131 can be supported by the stator cover 1611. In addition, a rod-shaped cover coupling member 136 can penetrate the stator cover 1611 to pass an edge of the outer stator 131 to thereby be inserted into the frame head portion 121. Accordingly, the motor unit 130 can be stably fixed between the rear surface of the frame head portion 121 and a front surface of the stator cover 1611 by the cover coupling member 136.

In some implementations, the stator cover 1611 not only supports the outer stator 131, but also supports a front resonant spring. Accordingly, the stator cover 1611 can include a part of the motor unit 130, and a part of the resonance unit 160. In some implementations, the stator cover 1611 can be defined as a part of the resonance unit 160 and will be described later together with the resonance unit.

The inner stator 132 can be inserted into the inner circumferential surface of the frame body portion 122. The inner stator 132 can be stacked in the circumferential direction on an outer side of the frame body portion 122 so that a plurality of lamination sheets forming the inner stator core surround the frame body portion 122.

The mover 130*b* can include a magnet frame 1331 and a magnet 1332 supported by the magnet frame 1331.

The magnet frame 1331 can be defined in a cylindrical shape with an open front surface and a closed rear surface. Accordingly, a front side of the magnet frame 1331 can be inserted from a rear side to a front side of the motor unit 130 so as to be disposed in a gap between the outer stator 131 and the inner stator 132, and a rear side of the magnet frame 1331 can be disposed between the rear side of the motor unit 130 and a front side of the resonance unit 160.

A front outer circumferential surface of the magnet frame 1331 can be provided with the magnet 1332 fixedly installed thereon. For example, a magnet insertion groove can be formed on the front outer circumferential surface of the magnet frame 1331, and the magnet 1332 can be inserted into the magnet insertion groove. The magnet 1332 can be provided in plurality and fixed at predetermined intervals in the circumferential direction, or can have a single cylindrical shape to be fixed thereto.

A muffler insertion hole 1331*a* can be formed in a center of a rear surface of the magnet frame 1331, and a suction muffler 151 can be inserted into the muffler insertion hole 1331*a*. The suction muffler will be described later.

The rear surface of the magnet frame 1331 can be provided with a spring supporter 1613 coupled thereto together with the piston 142.

Referring to FIG. 2, the compression unit 140 can include the cylinder 141, the piston 142, a suction valve 143, a discharge valve assembly 144, the suction muffler 151, and a discharge cover assembly 155.

The cylinder 141 can be made of a material which is light and has excellent processability, such as an aluminum material (aluminum or aluminum alloy). The cylinder 141 can be defined in a cylindrical shape and inserted into the frame 120.

The piston 142 can be inserted into the cylinder 141 to form a compression space V inside a front side of the cylinder 141 while reciprocating. The compression space V can be provided with the suction valve 143 and the discharge valve assembly 144, each to communicate with a suction flow path 1421 of the piston 142, and a discharge space S of the discharge valve assembly 144.

The cylinder 141 can be provided with the gas bearing 1411. The gas bearing 1411 can be formed through the outer circumferential surface and an inner circumferential surface of the cylinder 141 in the radial direction at a position in communication with the bearing communication groove 125*c*. Accordingly, some portion of refrigerant discharged into the discharge space S can be supplied to a bearing surface between the inner circumferential surface 141*a* of the cylinder 141 and an outer circumferential surface 142*a* of the piston 142, through the gas bearing passage portion and the gas bearing 1411. As the refrigerant creates a high pressure, the piston 142 can float from the cylinder 141 to reciprocate while being spaced apart from the cylinder 141.

In some implementations, a range of the bearing surface can vary according to the reciprocating motion of the piston 142. Accordingly, a front side of the bearing surface can communicate with the compression space V, and a rear side of the bearing surface can communicate with the inner space 110*a* of the shell 110 forming the suction space.

When the gas bearing 1411 is too close to the compression space V or the suction space, the high-pressure refrigerant supplied to the bearing surface leaks into the compression space V or the suction space, thereby reducing compressor efficiency. Therefore, it may be preferable that the gas bearing 1411 is at a position not directly communicated with the compression space V or the suction space. The gas bearing 1411 will be described later.

The piston 142 can be made of an aluminum material, like the cylinder 141. The piston 142 can be defined in a cylindrical shape in which a front end of the piston 142 is partially opened while a rear end of the piston 142 is fully opened.

In some implementations, the open rear end of the piston 142 can be connected to the magnet frame 1331. Accordingly, the piston 142 can reciprocate together with the magnet frame 1331.

In some implementations, the suction flow path 1421 can be formed through the piston 142 in the axial direction, and a suction port 1422 to communicate between the suction flow path 1421 and the compression space V can be formed at a front end of the piston 142. The suction port 1422 can be formed such that only one suction port 1422 is formed at a center of the front end of the piston 142 or a plurality of suction ports 1422 are formed at a periphery of the front end of the piston 142.

In some implementations, a front surface of the piston 142 can be provided with the suction valve 143 to selectively open and close the suction port 1422.

The suction valve 143 can be implemented as a thin steel plate and bolted to a front end surface of the piston 142. The suction valve 143 can be implemented as a type of a reed valve having one or more opening and closing portions.

The discharge valve assembly 144 can be provided at a front end of the cylinder 141 to open and close a discharge side of the compression space V. The discharge valve assembly 144 can be accommodated in the discharge space S of the discharge cover assembly 146.

The discharge valve assembly 144 can include a discharge valve 1441, a valve spring 1442, and a spring support member 1443.

The discharge valve 1441 can include a valve body portion 1441*a* facing the cylinder 141, and a spring coupling portion 1441*b* facing the discharge cover assembly 155. The valve body portion 1441*a* and the spring coupling portion 1441*b* can be molded into a single body, or can be fabricated separately and assembled after the fabrication.

In some implementations, the valve body portion 1441*a* can be defined in a disk shape or a hemispherical shape, and the spring coupling portion 1441*b* can be defined in a rod shape extending in the axial direction from a center of a front surface of the valve body portion 1441*a*.

In some implementations, the valve body portion 1441*a* can be formed by resin containing carbon fibers. The carbon fibers can be irregularly arranged, or can be regularly arranged such as being woven in a lattice shape or arranged in one direction. For example, when the carbon fibers are regularly arranged, it is preferable that the carbon fibers are arranged parallel to a front end surface of the cylinder 141 so as to reduce damage on the cylinder upon collision.

The valve spring 1442 can be implemented as a leaf spring or a compressed coil spring. The valve spring 1442 can be implemented as a disk-shaped leaf spring and can be coupled to the spring coupling portion 1441*b*.

The spring support member 1443 can be defined in an annular shape, and can enclose a rim of the valve spring 1442 in such a manner that the valve spring 1442 is inserted into an inner circumferential surface of the spring support member 1443. A thickness of the spring support member 1443 can be greater than a thickness of the valve spring 1442 so that the valve spring 1442 generates an elastic force.

Referring to FIG. 2, the suction and discharge unit 150 can include the suction muffler 151 and the discharge cover assembly 155. The suction muffler 151 can be provided at the suction side, and the discharge cover assembly 155 can be provided at the discharge side with the compression space V interposed therebetween.

The suction muffler 151 can pass through the muffler insertion hole 1331*a* of the magnet frame 1331 so as to be inserted into the suction flow path 1421 of the piston 142. Accordingly, refrigerant sucked into the inner space 110*a* of the shell 110 can be introduced into the suction flow path 1421 through the suction muffler 151 to open the suction valve 143 to thereby be sucked into the compression space V formed between the piston 142 and the cylinder 141 through the suction port 1422.

In some implementations, the suction muffler 151 can be fixed to the rear surface of the magnet frame 1331. For example, the suction muffler 151 is coupled to the piston 142. The suction muffler 151 can reduce noise generated while refrigerant is sucked into the compression space V through the suction flow path 1421 of the piston 142.

In some implementations, the suction muffler 151 can include a plurality of mufflers. For example, the plurality of mufflers can include a first muffler 1511, a second muffler 1512, and a third muffler 1513 to be coupled to each other.

The first muffler 1511 can be disposed inside the piston 142, and the second muffler 1512 can be coupled to a rear end of the first muffler 1511. Further, the third muffler 1513 can accommodate the second muffler 1512 therein, and a front end of the third muffler 1513 can be coupled to the rear end of the first muffler 1511. Accordingly, refrigerant can sequentially pass through the first muffler 1511, the second muffler 1512, and the third muffler 1513. In this process, flow noise of the refrigerant can be attenuated.

In some implementations, the suction muffler 151 can be provided with a muffler filter 1514 mounted thereon. The muffler filter 1514 can be disposed at a boundary at which the second muffler 1512 and the third muffler 1513 are coupled. For example, the muffler filter 1514 can be defined in a circular shape, and a rim of the muffler filter 1514 can be supported with being placed between surfaces of the second muffler 1512 and the third muffler 1513 where the second muffler 1512 and the third muffler 1513 are coupled.

The discharge cover assembly 155 can receive the discharge valve assembly 144 so as to be coupled to a front surface of the frame 120. The discharge cover assembly 155 can be implemented as a single discharge cover or can be implemented as a plurality of discharge covers. The discharge cover assembly 155 can be formed such that the plurality of discharge covers are arranged to overlap each other. For convenience, a discharge cover located inside is defined as a discharge cover, and a discharge cover located outside is defined as a cover housing according to an order of discharge of refrigerant.

For example, the discharge cover assembly 155 can include a discharge cover 1551 accommodating the discharge valve assembly 144, and the cover housing 1555 accommodating the discharge cover 1551 and fixed to the front surface of the frame 120. The discharge cover 1551 can be made of engineering plastic that withstands high temperature, and the cover housing 1555 can be made of aluminum die-cast.

The discharge cover 1551 can include a cover body portion 1551*a*, a cover flange portion 1551*b* radially extending from an outer circumferential surface of the cover body portion 1551*a*, and a cover protrusion 1551*c* forwardly extending from the cover flange portion 1551*b*.

The cover body portion 1551*a* can be defined in a container shape with an open rear surface and a partially closed front surface, and can be inserted into an outer discharge space S2 of the cover housing 1555. An inner space of the cover body portion 1551*a* can form an inner discharge space S1. As the discharge valve assembly 144 is accommodated in the inner discharge space S1, the inner discharge space S1 can form a first discharge space with respect to an order of discharge of refrigerant.

A central portion of a front surface of the cover body portion 1551*a* can be provided with a cover boss portion 1551*d* extending therefrom in a direction toward the discharge valve assembly 144. The cover boss portion 1551*d* can be defined in a cylindrical shape, and a center of a rear surface of the cover boss portion 1551*d* can be provided with a communication hole 1551*e* formed therethrough to communicate between the inner discharge space S1 of the discharge cover 1551 and the outer discharge space S2 of the cover housing 1555. Accordingly, the outer discharge space S2 can form a second discharge space with respect to an order of discharge of refrigerant.

The cover flange portion 1551*b* can extend in a flange shape from a front outer circumferential surface of the cover body portion 1551*a*. A rear surface of the cover flange portion 1551*b* can be closely adhered to and supported by the spring support member 1443 forming a part of the discharge valve assembly 144 in the axial direction, and a front surface of the cover flange portion 1551*b* can be closely adhered to and supported by a cover support portion 1555*b* of the cover housing in the axial direction.

The cover protrusion 1551*c* can extend from an edge of a front surface of the cover flange portion 1551*b* toward an inner surface of the cover housing 1555. The cover protrusion 1551*c* can be defined in a cylindrical shape. Accordingly, an outer circumferential surface of the cover protrusion 1551*c* can be closely adhered to and supported by an inner surface of a housing circumferential wall portion 1555*a* of the cover housing 1555 in the radial direction.

In some implementations, the cover housing 1555 can be fixed to the front surface of the frame head portion 121, and can form the outer discharge space S2 therein. One side of the outer discharge space S2 can communicate with the inner discharge space S1 of the discharge cover 1551 through the communication hole 1551*e* of the discharge cover 1551 described above, and another side of the outer discharge space S2 can be connected to the refrigerant discharge pipe 1142 through a loop pipe 1144.

For example, the cover housing 1555 can be defined in a container shape with a closed front surface and an open rear surface. The housing circumferential wall portion 1555*a* forming a side wall surface of the cover housing 1555 can be defined in a substantially cylindrical shape, and a rear end of the housing circumferential wall portion 1555*a* can be closely coupled to the front surface of the frame 120 with an insulating member disposed therebetween.

Inside the cover housing 1555, the cover support portion 1555*b* extending from an inner front surface toward the frame 120 can be provided. The cover support portion 1555*b* can be defined in a cylindrical shape with being spaced apart from the housing circumferential wall portion 1555*a* of the cover housing 1555 by a predetermined distance. Accordingly, an inner space of the cover housing 1555 can be divided into an inner space and an outer space in the radial direction by the cover support portion 1555*b*.

The cover body portion 1551*a* of the discharge cover 1551 can be inserted into the inner space of the cover housing 1555, and the cover protrusion 1551*c* of the discharge cover 1551 can be inserted into an outer space of the cover housing 1555. The cover flange portion 1551*b* of the discharge cover 1551 can be supported in the axial direction at a front end of the cover support portion 1555*b*.

In some implementations, a circumferential wall surface of the cover housing 1555 can be provided with a pipe coupling portion formed therethrough, and one end of the loop pipe 1144 bent several times in the inner space 110*a* of the shell 110 can be connected to the pipe coupling portion. Another end of the loop pipe 1144 can be connected to the refrigerant discharge pipe 1142. Accordingly, refrigerant discharged to the outer discharge space S2 can be guided to the refrigerant discharge pipe 1142 through the loop pipe 1144, and the refrigerant can be guided to the refrigeration cycle device through the refrigerant pipe.

Referring to FIG. 2, the resonance unit 160 can include a support portion 161 and a resonant spring 162 supported by the support portion 161.

The support portion 161 can include members each supporting a front end and a rear end of the resonant spring 162, respectively. For example, the support portion 161 can include a stator cover 1611, a rear cover 1612, and a spring supporter 1613.

As described above, the stator cover 1611 can be in close contact with the rear surface of the outer stator 131 and fixed to the frame 120 by the cover coupling member 136, and the rear cover 1612 can be fixedly coupled to a rear surface of the stator cover 1611. In some implementations, the spring supporter 1613 can be coupled to the magnet frame 1331 and the piston 142, and can be disposed between the stator cover 1611 and the rear cover 1612.

Accordingly, with respect to the spring supporter 1613, the stator cover 1611 can be disposed forward and the rear cover 1612 can be disposed rearward. In some implementations, a first resonant spring 1621 can be installed between the stator cover 1611 and the spring supporter 1613, and a second resonant spring 1622 can be installed between the spring supporter 1613 and the rear cover 1612.

The stator cover 1611 can be defined in an annular shape as described above, the rear cover 1612 can have a support leg portion 1612*a* so as to be axially spaced apart from the stator cover 1611, and the spring supporter 1613 can be spaced apart from the stator cover 1611 and the rear cover 1612, respectively, in the axial direction.

In some implementations, when the resonant spring 162 is implemented as a single body, the spring supporter 1613 can be excluded. An example in which the resonant spring 162 includes the first resonant spring 1621 installed at a front side and the second resonant spring 1622 installed at a rear side with the spring supporter 1613 disposed therebetween will be mainly described.

The spring supporter 1613 can be fixedly coupled to the rear surface of the magnet frame 1331. Accordingly, the spring supporter 1613 can be integrally coupled to the magnet frame 1331 and the piston 142 so as to reciprocate in a straight line together with the magnet frame 1331 and the piston 142.

In some implementations, the resonant spring 162 can include the first resonant spring 1621 and the second resonant spring 1622.

The first resonant spring 1621 and the second resonant spring 1622 each can be implemented as a compressed coil spring. The first resonant spring 1621 and the second resonant spring 1622 can be disposed symmetrically in the axial direction with the spring support portion 1617 interposed therebetween.

For example, a front end of the first resonant spring 1621 can be supported by the rear surface of the stator cover 1611, and a rear end of the first resonant spring 1621 can be supported by the front surface of the spring support portion 1617.

In some implementations, a front end of the second resonant spring 1622 can be supported by the rear surface of the spring support portion 1617, and a rear end of the second resonant spring 1622 can be supported by a front surface of the rear cover 1612.

Accordingly, the first resonant springs 1621 provided on the front side of the spring supporter 1613 and the second resonant springs 1622 provided on the rear side of the spring supporter 1613 can stretch in opposite directions to thereby resonate the mover 130*b* and the piston 142.

Further, referring to FIG. 2, spring caps 163 can be coupled to each of the spring support portions 1617, and an end portion of the resonant spring 162 can be fixedly inserted onto the spring cap 163. Accordingly, a state in which the resonant spring 162 is assembled to the spring support portion 1617 can be maintained.

To this end, cap support holes 1617*a* can be formed through the plurality of spring support portion 1617, respectively. The cap support holes 1617*a* can be formed according to the number and position of the first resonant spring 1621 and the second resonant spring 1622 facing each other.

For example, when the first resonant spring 1621 and the second resonant spring 1622 are respectively coupled to a front surface and a rear surface of the spring support portion 1617, each of the spring support portions 1617 can be provided with two cap support holes 1617*a* formed therethrough. In some implementations, the spring cap 163 can be fixedly inserted into each of the cap support holes 1617*a*.

Accordingly, when six first resonant springs 1621, six second resonant springs 1622, and three spring support portions 1617 are provided, each of the three spring support portions 1617 can support two first resonant springs 1621 and two second resonant springs 1622, and therefore, a total of 12 spring caps 163 can be provided at front and rear surfaces of the spring support portions 1617. Hereinafter, a spring cap provided at the front surface of the spring support portion 1617 to which the first resonant spring 1621 is coupled is defined as a first cap 1631, and a spring cap provided at the rear surface of the spring support portion 1617 to which the second resonant spring 1622 is coupled is defined as a second cap 1632.

The plurality of spring caps 163 can be identical to each other. For example, the spring caps 163 provided in the circumferential direction each can include the first cap 1631 and the second cap 1632 identical to each other.

In some implementations, the first cap 1631 and the second cap 1632 can be formed symmetrically with respect to each of the spring support portions 1617, or can be formed differently. For example, when the spring cap 163 acts as a silencer such as a Helmholtz resonator, the spring cap 163 can be defined in various shapes.

By way of further example, the first cap 1631 and the second cap 1632 can have a noise reducing space portion 163*a* formed therein, and at least one of the first cap 1631 and the second cap 1632 can have a noise reducing passage portion 163*b* formed therethrough in the axial direction to communicate an inner space of the shell 110 with the noise reducing space portion 163*a*. Accordingly, noise in various frequency bands generated while the compressor is operating can be attenuated by the noise reducing space portion 163*a* and the noise reducing passage portion 163*b* provided in the spring cap 163.

The linear compressor can operate as follows.

When current is applied to the winding coil 134 of the motor unit 130 to form a magnetic flux between the outer stator 131 and the inner stator 132, the mover 130*b* including the magnet frame 1331 and the magnet 1332 can reciprocate in a gap between the outer stator 131 and the inner stator 132 by an electromagnetic force generated by the magnetic flux.

Then, the piston 142 connected to the magnet frame 1331 reciprocates in the axial direction in the cylinder 141 to thereby increase or decrease a volume of the compression space V. Here, when the piston 142 is moved backward to increase the volume of the compression space V, the suction valve 143 is opened so that refrigerant in the suction flow path 1421 is introduced into the compression space V. On the other hand, when the piston 142 is moved forward to decrease the volume of the compression space V, pressure in the compression space V increases. Then, refrigerant compressed in the compression space V opens the discharge valve 1441 to thereby be discharged to a first discharge space S1 of the discharge cover 1551.

Then, the refrigerant discharged to the first discharge space S1 can move to a second discharge space S2 of the cover housing 1555 through the communication hole 1551*e*. Here, part of the refrigerant moving from the first discharge space S1 to the second discharge space S2 is introduced into the bearing inlet groove 125*a* forming an inlet of the gas bearing. The refrigerant can be then supplied to the bearing surface between the inner circumferential surface 141*a* of the cylinder 141 and the outer circumferential surface 142*a* of the piston 142 through the bearing communication hole 125*b*, the bearing communication groove 125*c*, and the gas bearing 1411 of the cylinder 141. Thereafter, high-pressure refrigerant supplied to the bearing surface can lubricate between the cylinder 141 and the piston 142, and then part of the refrigerant can flow into the compression space V and the rest of the refrigerant flows into the inner space 110*a* of the shell 110 which is a suction space.

The refrigerant introduced into the second discharge space S2 can be discharged outwardly of the compressor through the loop pipe 1144 and the refrigerant discharge pipe 1142, then moved to a condenser of the refrigeration cycle. This series of processes is repeatedly performed.

In some implementations, since the oil bearing is excluded and the gas bearing is adopted as described above, a friction loss of the compressor due to a shortage of oil can be limited while reducing a size of the compressor.

In the gas bearing 1411 described above, a gas hole 1413 can be formed through the cylinder 141, and a gas pocket 1414 that determines a substantial bearing area can be formed at an outlet end of the gas hole 1413. For example, when a cross-sectional area of the gas pocket 1414 is large, an area in which high-pressure gas in the gas pocket 1414 affects the piston 142 can also be increased. Accordingly, the larger the cross-sectional area of the gas pocket 1414 is compared to a cross-sectional area of the gas hole 1413, the more advantageous it may be.

However, as the gas pocket 1414 is formed on the inner circumferential surface 141*a* of the cylinder 141 facing the outer circumferential surface of the piston 142, a surface of the piston 142 (for example, anodizing surface) may be scratched and damaged by the gas pocket 1414 during a reciprocating motion of the piston 142. Accordingly, a contact area between the piston 142 and the gas pocket 1414 increases as the cross-sectional area of the gas pocket 1414 increases, and thus an area of the piston 142 damaged by the gas pocket 1414 may be further increased.

In addition, when an edge of the gas pocket 1414 is formed at a right angle, the surface of the piston 142 may be further damaged as the edge of the gas pocket 1414 is sharp.

In addition, there may be a case where a center of the cylinder 141 and a center of the piston 142 do not match due to sagging of the piston 142 during a start-up or operation of the compressor. In this case, a leakage gap between the cylinder 141 and the piston 142 increases as an area of the gas pocket 1414 increases. Accordingly, high-pressure gas supplied to the gas pocket 1414 may leak from the gas pocket 1414, and this may reduce a levitation force against the piston 142.

With this reason, in some implementations, a length of the gas pocket in the circumferential direction can be reduced by lengthening the gas pocket in a lengthwise direction of the cylinder. Accordingly, a volume of the gas pocket can be secured, and thereby reducing a frictional area with the piston. Further, damage to the surface of the piston can be suppressed by forming the edge of the gas pocket at an obtuse angle. Moreover, the leakage gap between the cylinder and the piston can be minimized by reducing the length of the gas pocket in the circumferential direction.

Figure 3:
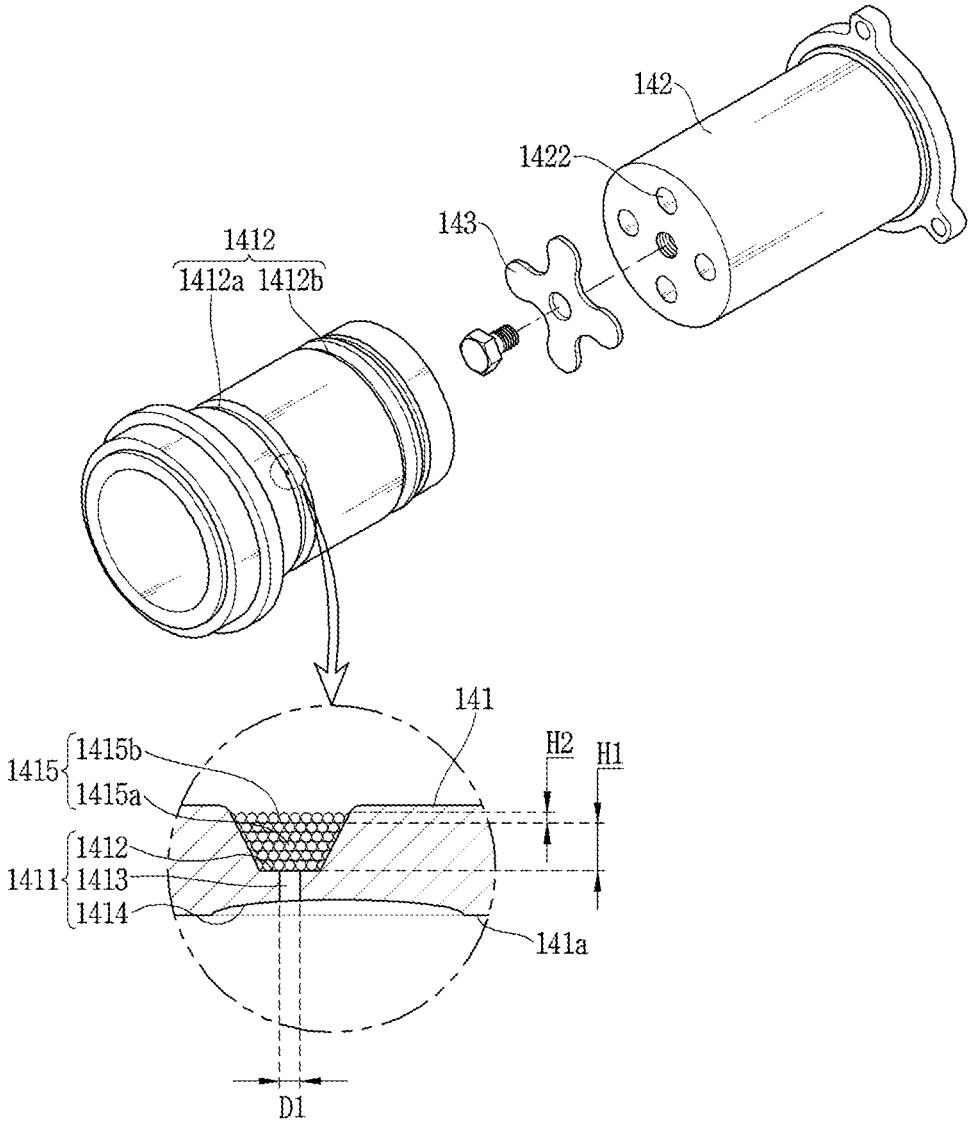
FIG. 3 is a diagram illustrating an exploded perspective view of a cylinder and a piston of a linear compressor.
Figure 4:
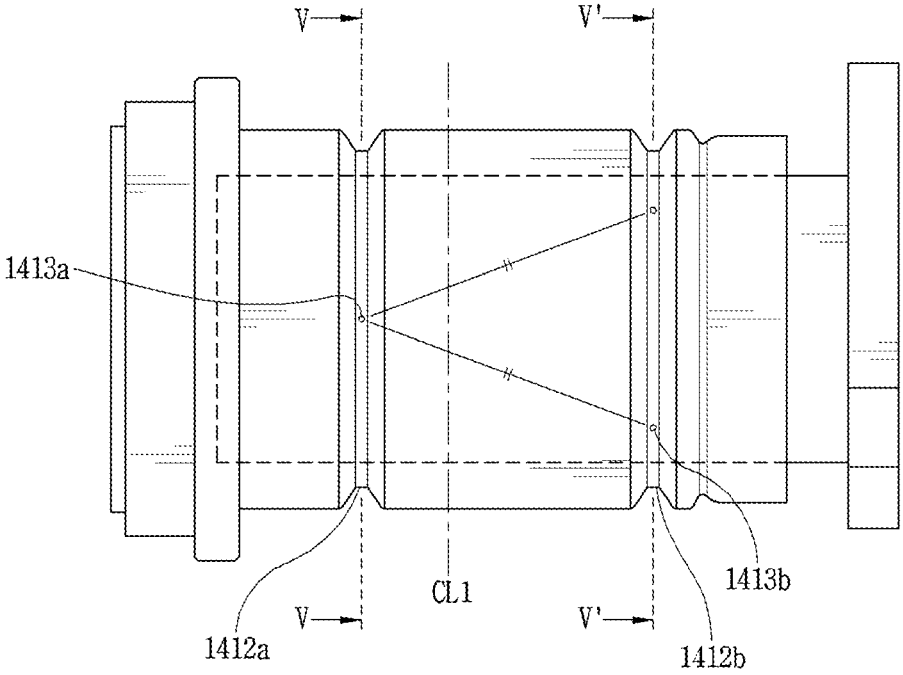
FIG. 4 is a diagram illustrating an assembled front view of the cylinder and the piston of FIG. 3.
Figure 5A:
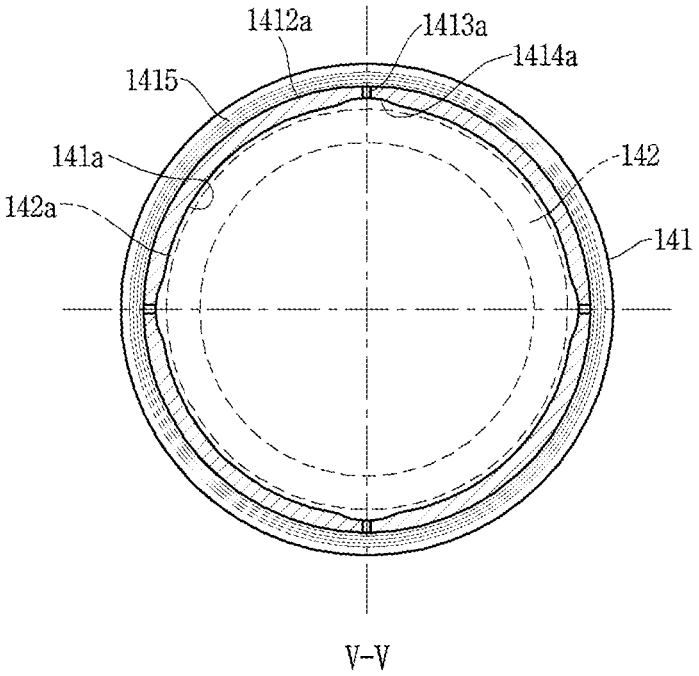
FIG. 5A is a diagram illustrating a sectional view taken along a line V-V of FIG. 4.
Figure 5B:
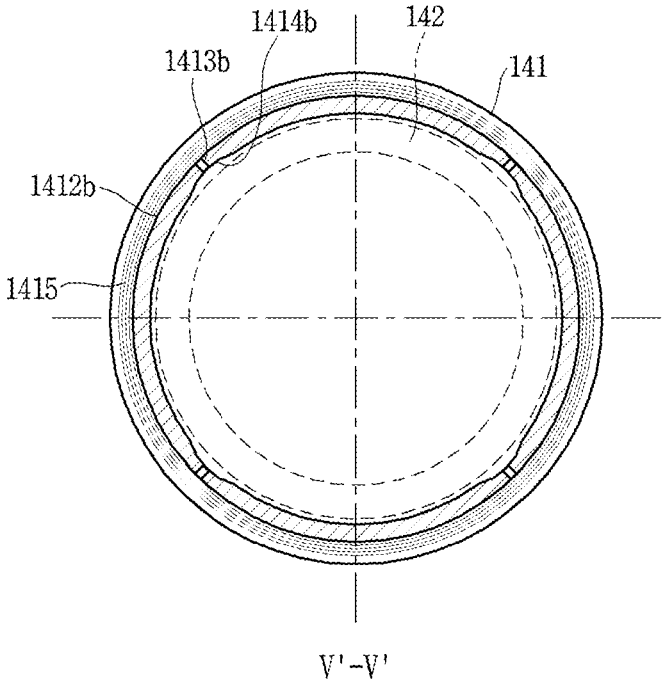
FIG. 5B is a diagram illustrating a sectional view taken along a line V'-V' of FIG. 4.

FIG. 3 is a diagram illustrating an exploded perspective view of the cylinder and the piston of the linear compressor, FIG. 4 is a diagram illustrating an assembled front view of the cylinder and the piston of FIG. 3, FIG. 5A is a diagram illustrating a sectional view taken along the line V-V of FIG. 4, and FIG. 5B is a diagram illustrating a sectional view taken along the line V'-V' of FIG. 4.

Referring to FIGS. 3 and 4, the gas bearing 1411 can include a gas guide groove 1412, the gas hole 1413, and the gas pocket 1414. The gas guide groove 1412 can form an inlet of the gas bearing 1411, the gas pocket 1414 can form an outlet of the gas bearing 1411, and the gas hole 1413 can form a connection passage connecting between the gas guide groove 1412 and the gas pocket 1414.

For example, the gas guide groove 1412 is formed on an outer circumferential surface of the cylinder 141, the gas pocket 1414 is formed on an inner circumferential surface of the cylinder 141, and the gas hole 1413 is formed between the gas guide groove 1412 and the gas pocket 1414 to communicate the gas guide groove 1412 with the gas pocket 1414. Accordingly, one end of the gas hole 1413 can be formed inside the gas guide groove 1412, and another end of the gas hole 1413 can be formed inside the gas pocket 1414.

The gas guide groove 1412 can be recessed from the outer circumferential surface of the cylinder 141 by a predetermined depth in the radial direction. The gas guide groove 1412 can be formed individually so that each of the gas holes 1413 is independently communicated therewith, or the gas guide groove 1412 can be formed in an annular shape so that a plurality of gas holes 1413 are collectively communicated. An example in which the gas guide groove 1412 is formed in an annular shape will be described.

The gas guide groove 1412 can be provided with a filter 1415 to block foreign substances and reduce pressure. The filter 1415 can block foreign substances from being introduced into the gas hole 1413 to limit clogging of the gas hole 1413, and the high-pressure gas supplied to the gas pocket 1414 can be decompressed so as to have an appropriate pressure.

The gas guide groove 1412 can further include a first gas guide groove 1412*a*, and a second gas guide groove 1412*b*.

The filter 1415 can be a mesh filter made of metal or can be made by winding a fiber wire such as a thin thread. The filter 1415 can be defined as a thread filter or a wire filter, and will be described below by defining it as a wire filter.

The wire filter 1415 can be made of one kind of material or can be made of a plurality of kinds of materials. When the wire filter 1415 is made of a plurality of kinds of materials, a plurality of wires made of different materials can be twisted to form a braided yarn shape.

A thickness of the braided yarn forming the wire filter 1415 can be smaller than an inner diameter D1 of the gas hole 1413. For example, when the inner diameter D1 of the gas hole 1413 is about 0.5 mm, the thickness of the braided yarn can be about 0.04 mm. This can limit an inlet of the gas hole 1413 from being excessively blocked by the braided yarn.

In some implementations, the wire filter 1415 can include a plurality of wire layers wound on the gas guide groove 1412 in a height direction of the gas guide groove 1412. For example, the wire filter 1415 can include a first wire layer 1415*a* wound from a bottom surface of the gas guide groove 1412 up to a predetermined height, and a second wire layer 1415*b* wound on an outer surface of the first wire layer 1415*a*.

A radial height H1 of the first wire layer 1415*a* can be greater than a radial height H2 of the second wire layer 1415*b*, and a density of the second wire layer 1415*b* can be greater than a density of the first wire layer 1415*a*. Accordingly, voids in the second wire layer 1415*b* can be smaller than voids in the first wire layer 1415*a*. In some implementations, the second wire layer 1415*b* can be formed very thin compared to the first wire layer 1415*a*. Accordingly, the high-pressure gas moving toward the gas hole 1413 may not be excessively blocked by the second wire layer 1415*b*.

The first wire layer 1415*a* and the second wire layer 1415*b* can be formed by a surface welding process of the wire filter 1415. For example, the wire filter 1415 can be made up of a braided yarn formed by combining polyethylene terephthalate (PET) and polytetrafluoroethylene (PTFE). A melting point of PET is 260° C. and a melting point of PTFE is 327° C.

In some implementations, the wire filter 1415 can be formed such that the braided yarn is wound around the gas guide groove 1412 and then an outer surface of the braid yarn is heated to weld an outer circumferential surface of the wire filter 1415. With the surface welding process, the wire filter 1415 can be largely divided into the first wire layer 1415*a* and the second wire layer 1415*b* in the radial direction. Accordingly, the outer circumferential surface of the wire filter 1415 can be aligned at a uniform height, and the second wire layer 1415*b* forming an outer circumferential side of the wire filter 1415 can be thinner than the first wire layer 1415*a* forming an inner circumferential side of the wire filter 1415.

In some implementations, the gas hole 1413 can penetrate from the bottom surface of the gas guide groove 1412 to the inner circumferential surface 141*a* of the cylinder 141. The inner diameter D1 of the gas hole 1413 can be significantly smaller than an inner diameter of the gas guide groove 1412 (specifically, an inner cross-sectional area of the gas guide groove). Accordingly, the gas hole 1413 can form a kind of orifice, and a flow rate of the high-pressure gas passing through the gas hole 1413 can be reduced and the pressure of the high-pressure gas can be greatly reduced.

Specifically, one end of the gas hole 1413 can communicate with the gas guide groove 1412 formed on the outer circumferential surface of the cylinder 141, and another end of the gas hole 1413 can communicate with the gas pocket 1414 formed on the inner circumferential surface 141*a* of the cylinder 141. Accordingly, the gas guide groove 1412 and the gas pocket 1414 can communicate with each other through the gas hole 1413, so that refrigerant guided to the gas guide groove 1412 is delivered to the gas pocket 1414 through the gas hole 1413.

The gas holes 1413 can be spaced apart from each other at predetermined intervals in the circumferential direction in the gas guide groove 1412. For example, the gas holes 1413 can be disposed at equal intervals in the circumferential direction at the bottom surface of the gas guide groove 1412.

Further, the gas hole 1413 can be disposed only at one point in the lengthwise direction (or the axial direction) of the cylinder 141. Here, the gas hole 1413 can be located at a central portion of the cylinder 141 in the lengthwise direction. However, as the piston 142 reciprocates in the lengthwise direction of the cylinder 141, it may be preferable that the gas holes 1413 are disposed at a front side and a rear side, respectively, with respect to a longitudinal center CL1 of the cylinder 141 in terms of a stability of the piston 142.

Referring to FIGS. 4, 5A, and 5B, the gas hole 1413 can include a first gas hole 1413*a* disposed at a front portion of the cylinder 141, and a second gas hole 1413*b* disposed at a rear portion of the cylinder 141. The first gas hole 1413*a* and the second gas hole 1413*b* each can be provided in plurality, and a plurality of first gas holes 1413*a* and a plurality of second gas holes 1413*b* each can be spaced apart at predetermined intervals in the circumferential direction.

In some implementations, the first gas holes 1413*a* and the second gas holes 1413*b* can be alternately disposed in the circumferential direction. For example, when the cylinder 141 is viewed from a side in the radial direction, one first gas hole 1413*a* can be disposed between two adjacent second gas holes 1413*b*. By way of further example, as illustrated in FIG. 4, the two second gas holes 1413*b* can be disposed at equal distances from the first gas hole 1413*a*.

Accordingly, the first gas hole 1413*a* and the second gas hole 1413*b* can be disposed on different lines in the lengthwise direction of the cylinder 141. Then, based on a constant total number (or area) of the gas holes 1413, the gas holes 1413 can be evenly distributed on the outer circumferential surface of the piston 142 to thereby support the piston 142 more stably.

In some implementations, the first gas hole 1413*a* and the second gas hole 1413*b* can be disposed on a same line in the lengthwise direction (or axial direction) of the cylinder 141. In this implementation, a shape of the first gas pocket 1414*a* and a shape of the second gas pocket 1414*b* can be formed symmetrically or asymmetrically.

For example, when the first gas pocket 1414*a* and the second gas pocket 1414*b* are formed asymmetrically, the first gas pocket 1414*a* can be elongated in the lengthwise direction, whereas the second gas pocket 1414*b* at which an amount of sagging of the piston 142 is relatively small can be elongated in the circumferential direction.

Referring to FIGS. 5A and 5B, the gas pockets 1414 can be formed individually on the inner circumferential surface 141*a* of the cylinder 141 so as to communicate independently with each of the gas holes 1413.

Specifically, the gas pockets 1414 can be matched with the gas holes 1413 in a one-to-one manner. Accordingly, the gas pocket can be formed such that the first gas pockets 1414*a* are disposed at the front portion of the cylinder 141, and the second gas pockets 1414*b* are disposed at the rear portion.

For example, the first gas pockets 1414*a* can be disposed at the front portion of the cylinder 141 so as to be communicated with the first gas holes 1413*a*, and the second gas pockets 1414*b* can be located at the rear portion of the cylinder 141 so as to be communicated with the second gas holes 1413*b*.

The first gas pockets 1414*a* at the front portion of the cylinder 141 and the second gas pockets 1414*b* at the rear portion of the cylinder 141 each can be spaced apart from each other at equal intervals in the circumferential direction, as in the case of the first gas holes 1413*a* and the second gas holes 1413*b* described above. Further, the first gas pockets 1414*a* and the second gas pockets 1414*b* can be alternately disposed in the circumferential direction. For example, the first gas pockets 1414*a* and the second gas pockets 1414*b* can be disposed at different positions in the lengthwise direction (or the axial direction) of the cylinder 141.

In some implementations, the first gas pocket 1414*a* and the second gas pocket 1414*b* can have a shape same as each other or different from each other. However, in the following, a description will be given focusing on the first gas pocket 1414*a* and an example in which the first gas pocket 1414*a* and the second gas pocket 1414*b* have an identical shape. When the second gas pocket 1414*b* has a shape identical to that of the first gas pocket 1414*a*, a description of the second gas pocket 1414*b* will be replaced with the description of the first gas pocket 1414*a*.

Figure 6:
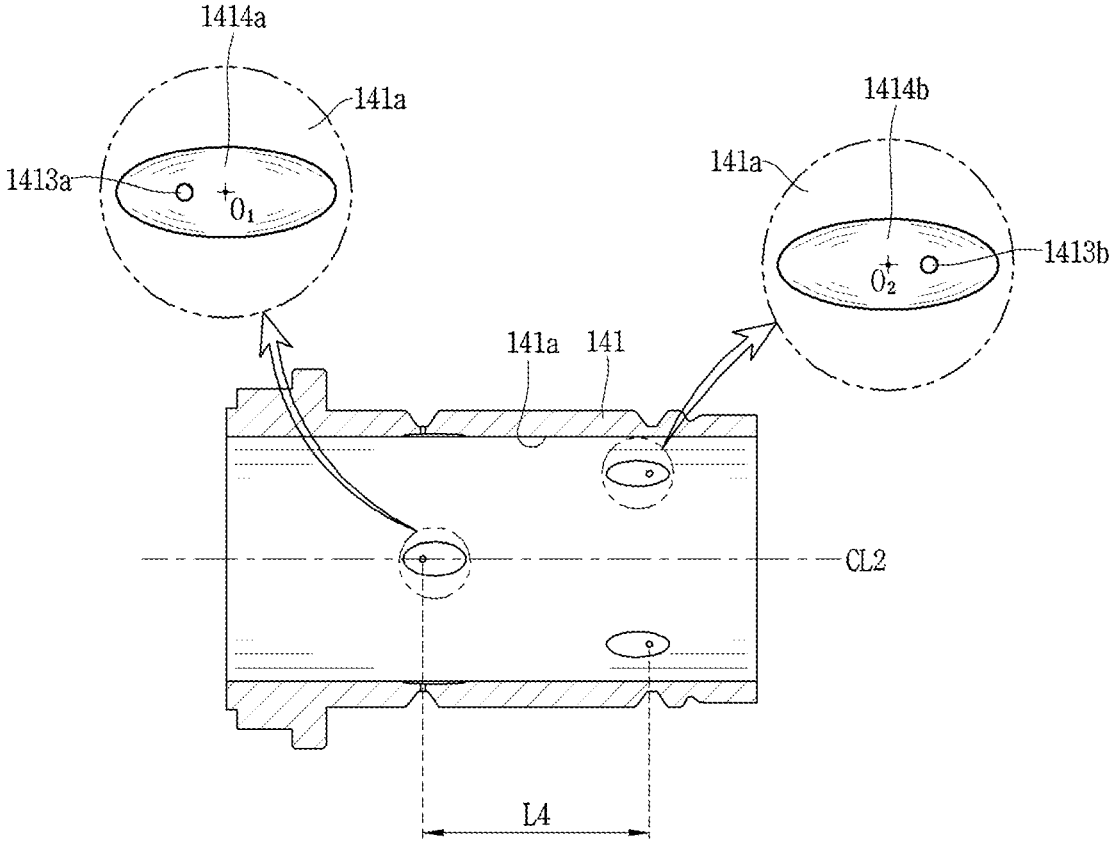
FIG. 6 is a diagram illustrating a sectional view illustrating an inner side of a cylinder.
Figure 7:
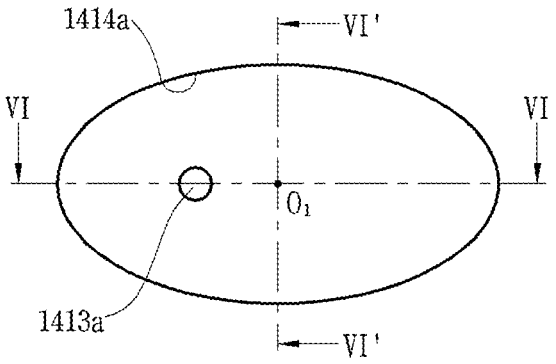
FIG. 7 is a diagram illustrating a schematic view of a first gas pocket in FIG. 6.
Figure 8A:
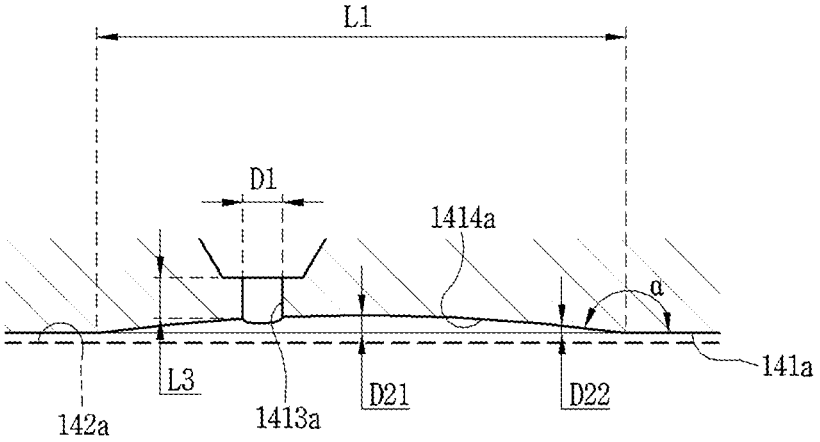
FIG. 8A is a diagram illustrating a sectional view taken along a line VI-VI of FIG. 7.
Figure 8B:
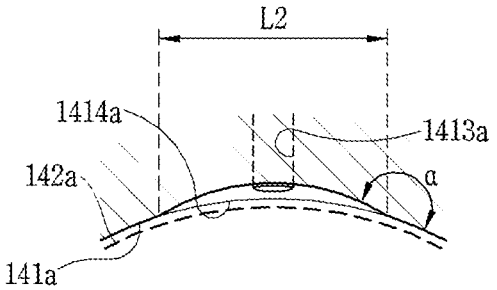
FIG. 8B is a diagram illustrating a sectional view taken along a line VI'-VI' of FIG. 7.

FIG. 6 is a diagram illustrating a sectional view of an inner side of the cylinder, FIG. 7 is a diagram illustrating a schematic view of the first gas pocket in FIG. 6, FIG. 8A is a diagram illustrating a sectional view taken along a line VI-VI of FIG. 7, and FIG. 8B is a diagram illustrating a sectional view taken along a line VI'-VI' of FIG. 7.

Referring to FIGS. 6, 7, 8A, and 8B, the first gas pocket 1414*a* can be elongated in the axial direction. For example, the first gas pocket 1414*a* can be formed such that an axial length L1 of the first gas pocket 1414*a* is longer than a circumferential length L2 of the first gas pocket 1414*a*.

By way of further example, when viewed from a central axis CL2 of the cylinder 141 in the radial direction, the first gas pocket 1414*a* can have an elliptical shape in which the lengthwise direction (or axial direction) of the cylinder 141 forms a long axis of the first gas pocket 1414*a* and the circumferential direction of the cylinder 141 forms a short axis of the first gas pocket 1414*a*.

Accordingly, based on a constant cross-sectional area of the first gas pocket 1414*a* when viewed in the radial direction, when the first gas pocket 1414*a* is elongated in the axial direction, a circumferential length of the first gas pocket 1414*a* can be shorter than an axial length of the first gas pocket 1414*a*.

Specifically, an inner circumferential surface of the first gas pocket 1414*a* can have an elliptically curved shape in the axial direction and in the circumferential direction, respectively. For example, as illustrated in FIGS. 7 and 8A, when viewed from a side of the cylinder 141, the first gas pocket 1414*a* can have a shape in which a central portion of the first gas pocket 1414*a* forms a radial long axis, and edges forming opposite ends of the first gas pocket 1414*a* form radial short axes. In addition, as illustrated in FIGS. 7 and 8B, when viewed from front or rear of the cylinder 141, the first gas pocket 1414*a* can be formed in a shape in which a central portion of the first gas pocket 1414*a* forms a radial long axis, and edges forming opposite ends of the first gas pocket 1414*a* form radial short axes.

In addition, when viewed from the side of the cylinder 141, a length of a radial axis of the first gas pocket 1414*a* can gradually decrease from the central portion of the first gas pocket 1414*a* to the edges of the first gas pocket 1414*a*, and when viewed from front or rear of the cylinder 141, a length of a radial axis of the first gas pocket 1414*a* can gradually decrease from the central portion of the first gas pocket 1414*a* to the edges of the first gas pocket 1414*a*. For example, the first gas pocket 1414*a* can have a dimple shape inwardly curved from the inner circumferential surface of the cylinder 141.

By way of further example, a depth D21 at a central portion of the first gas pocket 1414*a* can be deeper than a depth D22 at an edge portion of the first gas pocket 1414*a*. Accordingly, refrigerant introduced into the first gas pocket 1414*a* through the first gas hole 1413*a* can be widely diffused toward opposite ends of the first gas pocket 1414*a* in the axial direction and opposite ends of the first gas pocket 1414*a* in the circumferential direction at which a volume of the first gas pocket 1414*a* decreases. This can allow the refrigerant to be evenly distributed in the first gas pocket 1414*a* to thereby increase an actual area (i.e., a bearing area) of the first gas pocket 1414*a*, and therefore, the levitation force against the piston 142 can be increased.

Further, the central depth D21, which is a maximum depth of the first gas pocket 1414*a*, can be smaller (or shallower) than a radial length L3 of the first gas hole 1413*a*. Accordingly, a pressure reducing effect of the refrigerant passing through the first gas hole 1413*a* can be improved as much as the length of the first gas hole 1413*a* increases, and a fabrication process can be facilitated as much as the depth of the first gas pocket 1414*a* becomes shallower (see FIG. 8A).

In addition, in a case where the first gas pocket 1414*a* has an elliptical shape when viewed in the radial direction, an edge angle $\alpha$ formed between an inner surface of the first gas pocket 1414*a* and the inner circumferential surface of the cylinder 141 can form an obtuse angle, which is almost a straight surface. Accordingly, the edge of the first gas pocket 1414*a* can be smoothed, so that an anodized coating layer forming the outer circumferential surface of the piston 142 is limited from being scratched off by the edge of the gas pocket 1414. This can obviate an abrasion of the edge of the first gas pocket 1414*a* to thereby block leakage of the refrigerant from the first gas pocket 1414*a*.

In some implementations, the first gas hole 1413*a* can be formed through a center of the first gas pocket 1414*a* to communicate therewith. However, as the first gas pocket 1414*a* is elongated in the axial direction of the cylinder 141, it may be preferable that the first gas hole 1413*a* is deviated in the lengthwise direction from the center of the first gas pocket 1414*a*.

Specifically, referring to FIGS. 7 and 8A, when the first gas hole 1413*a* is formed through the center of the first gas pocket 1414*a* in the case where the first gas pocket 1414*a* is elongated in the axial direction of the cylinder 141, the first gas pocket 1414*a* can be disposed far from opposite ends of the cylinder 141 in consideration of an axial sealing distance. For example, in the linear compressor, a compression space is provided at a front side of the piston 142, a suction space forming the inner space of the shell is provided at a rear side of the piston 142, and the piston 142 reciprocates in the axial direction with respect to the cylinder 141. Accordingly, the first gas pocket 1414*a* and the second gas pocket 1414*b* can be formed within a reciprocating range (specifically, a reciprocating range including the sealing distance) of the piston 142. When the first gas pocket 1414*a* or the second gas pocket 1414*b* is formed outside the reciprocating range of the piston 142, suction loss may be caused as the first gas pocket 1414*a* communicates with the compression space, or the gas bearing 1411 may become unstable as the second gas pocket 1414*b* communicates with the suction space. In this regard, when the axial length of the first gas pocket 1414*a* (or the second gas pocket) is shortened, a support area for the piston 142 may be reduced.

In addition, as the piston 142 is supported in a form of a cantilever in the linear compressor, forming the gas holes as close as possible to opposite ends of the cylinder 141 may be advantageous in a view of the stability of the piston 142.

However, when the first gas pocket 1414*a* (or the second gas pocket) is elongated in the lengthwise direction of the cylinder 141, a position of the first gas hole 1413*a* (or the second gas hole) can be relatively far from the end of the cylinder 141. This may be disadvantageous in stably supporting the piston 142 because a gap between the first gas hole 1413*a* and the second gas hole 1413*b* is narrowed.

With this reason, in some implementations, the first gas hole 1413*a* can be deviated from a center O1 of the first gas pocket 1414*a*, and the second gas hole 1413*b* can be deviated from a center O2 of the second gas pocket 1414*b*. For example, as illustrated in FIG. 6, the first gas hole 1413*a* can be deviated from the center O1 of the first gas pocket 1414*a* toward the front end of the cylinder 141, and the second gas hole 1413*b* can be deviated from the center O2 of the second gas pocket 1414*b* toward a rear end of the cylinder 141.

Accordingly, a distance L4 between the first gas hole 1413*a* and the second gas hole 1413*b* can be widened as much as possible without reducing the axial length L1 of the first gas pocket 1414*a* and the axial length L1 of the second gas pocket 1414*b*. Then, the first gas hole 1413*a* and the second gas hole 1413*b* can be each disposed adjacent to respective end portions of the piston 142, so that the piston 142 performing the reciprocating motion is more stably supported.

In the case where the first gas pocket 1414*a* has an elliptical shape when viewed in the radial direction, the circumferential length of the first gas pocket 1414*a* can be shorter than the axial length of the first gas pocket 1414*a* (see FIG. 7).

Accordingly, a circumferential gap between the inner circumferential surface 141*a* of the cylinder 141 and the outer circumferential surface 142*a* of the piston 142 can be narrowed, thereby reducing leakage of the first gas pocket 1414*a* in which the refrigerant introduced into the first gas pocket 1414*a* is leaked out of the first gas pocket 1414*a*.

Figure 9A:
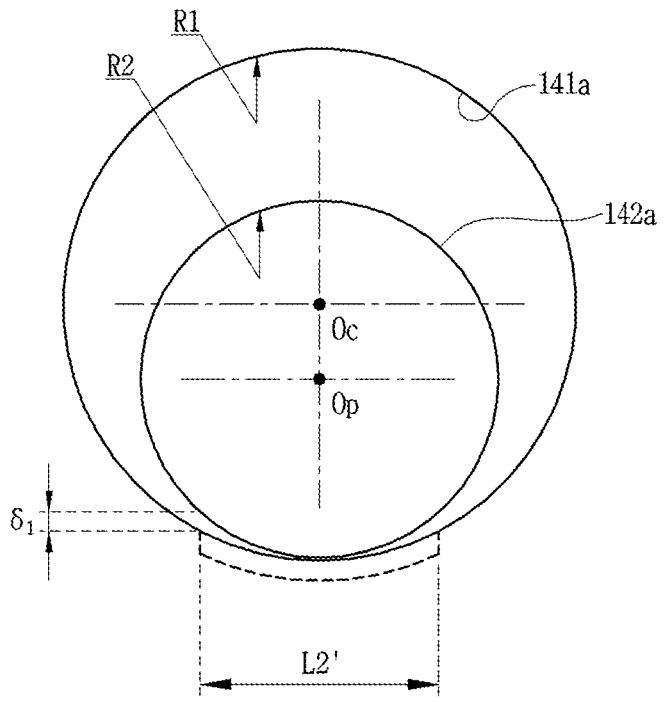
FIGS. 9A and 9B are diagrams illustrating a schematic view of a leakage gap between a cylinder and a piston.
Figure 9B:
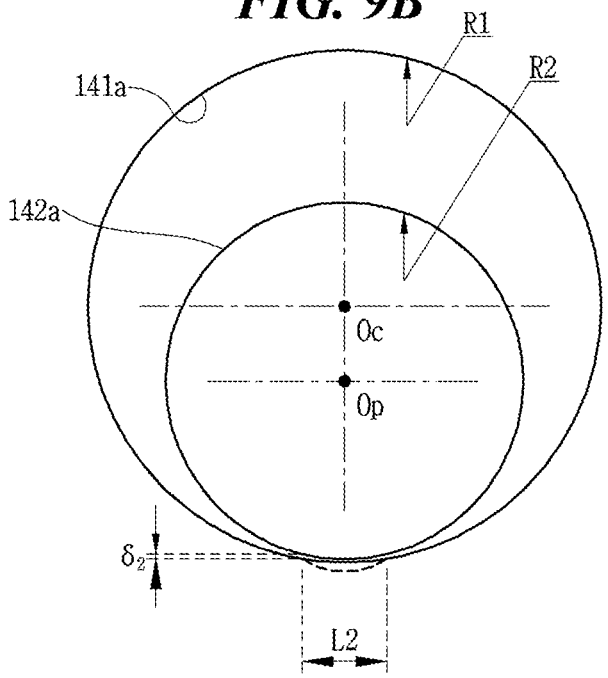
Figure 10A:
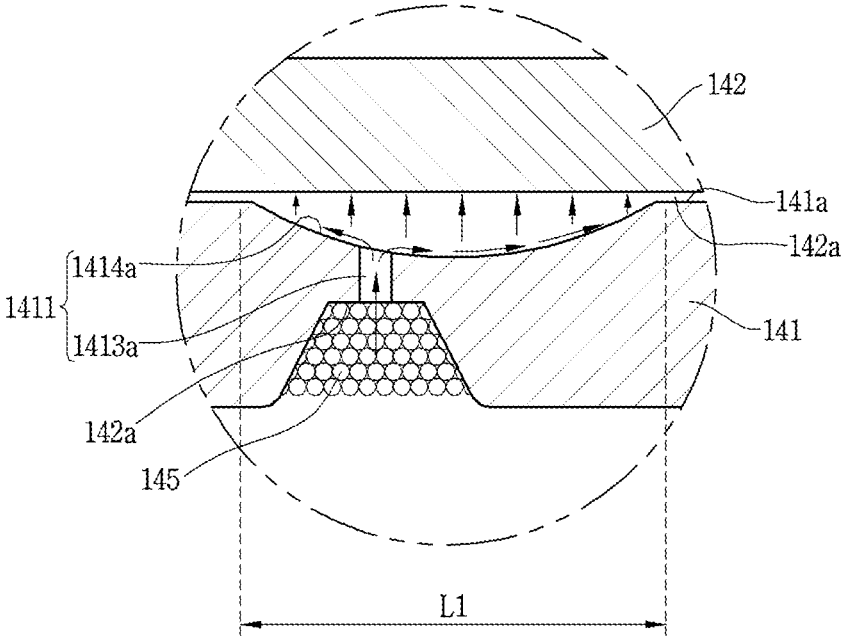
FIG. 10A is a diagram illustrating a schematic view of a levitation force of a gas pocket.
Figure 10B:
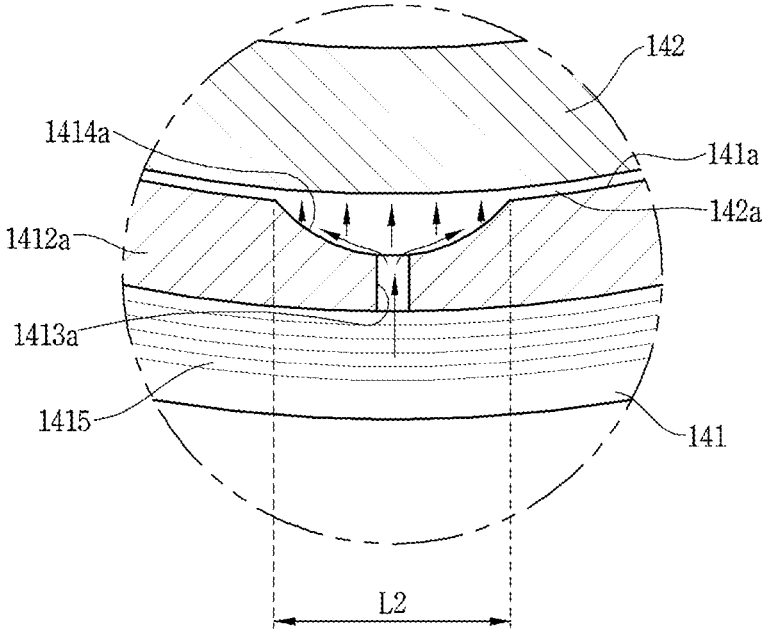
FIG. 10B is a diagram illustrating a schematic view of how much a piston is damaged due to a gas pocket.

FIGS. 9A and 9B are diagrams illustrating a schematic view of the leakage gap between the cylinder and the piston, FIG. 10A is a diagram illustrating a schematic view of a levitation force of the gas pocket, and FIG. 10B is a diagram illustrating a schematic view of how much the piston is damaged due to the gas pocket.

Referring to FIGS. 9A and 9B, since an inner circumferential curvature R1 of the cylinder 141 and an outer circumferential curvature R2 of the piston 142 have the same value, a circumferential gap δ1 between the inner circumferential surface 141*a* of the cylinder 141 and the outer circumferential surface 142*a* of the piston 142 and a circumferential gap δ2 between the inner circumferential surface 141*a* of the cylinder 141 and the outer circumferential surface 142*a* of the piston 142 can be theoretically the same throughout the entire area in the circumferential direction. However, as an outer diameter of the piston 142 is smaller than an inner diameter of the cylinder 141, the piston 142 is drooped by its own weight during actual operation of the compressor to thereby cause an eccentricity between an axial center Oc of the inner circumferential surface 141*a* of the cylinder 141 and an axial center Op of the outer circumferential surface 142*a* of the piston 142. The eccentricity is more severe at the beginning of operation of the compressor.

Then, as illustrated in FIGS. 9A and 9B, during operation of the compressor, the circumferential gaps δ1 and δ2 between the inner circumferential surface 141*a* of the cylinder 141 and the outer circumferential surface 142*a* of the piston 142 increase from the center of the first gas pocket 1414*a* toward opposite ends of the first gas pocket 1414*a*. Here, compared to the case where the first gas pocket 1414*a* is elongated in the circumferential direction as illustrated in FIG. 9A, the circumferential gap δ2 can be reduced when the first gas pocket 1414*a* is elongated in the lengthwise direction as illustrated in FIG. 9B.

For example, when the first gas pocket 1414*a* is elongated in the lengthwise direction, the circumferential gap δ2 between the cylinder 141 and the piston 142 at opposite ends of the first gas pocket 1414*a* is reduced as the circumferential length of the first gas pocket 1414*a* is shortened. This may block the refrigerant introduced into the first gas pocket 1414*a* from being leaked out of the first gas pocket 1414*a* to thereby increase the levitation force against the piston 142.

In some implementations, when the first gas pocket 1414*a* in the lengthwise direction has an elliptical cross-sectional shape when viewed from a side of the cylinder 141, the refrigerant introduced into the first gas pocket 1414*a* can be moved toward the edge of the first gas pocket 1414*a* at which the volume of the first gas pocket 1414*a* is relatively small. Then, internal pressure of the first gas pocket 1414*a* can be evenly distributed to thereby increase a surface area that actually supporting the piston 142, and accordingly, the piston 142 is more stably supported (see FIG. 10A).

In some implementations, the circumferential length L2 of the first gas pocket 1414*a* may be formed short to minimize leakage of refrigerant in the circumferential direction, but instead, the axial length L1 of the first gas pocket

1414*a* may be formed sufficiently long. Then, the cross-sectional area of the first gas pocket 1414*a* can be increased when viewed in the radial direction, so that the levitation force against the piston 142 is increased.

In some implementations, when the circumferential length L2 of the first gas pocket 1414*a* is shortened, that the outer circumferential surface of the piston 142 is scratched by the edges of the first gas pocket 1414*a* when the piston 142 reciprocates with respect to the cylinder 141 can be minimized.

Specifically, since the plurality of first gas pockets 1414*a* are recessed from the inner circumferential surface 141*a* of the cylinder 141, edges between the inner surface of the first gas pocket 1414*a* and the inner circumferential surface 141*a* of the cylinder 141 can be sharp. For example, when the piston 142 performs a sliding motion in a state in which a part of the outer circumferential surface of the piston 142 is in contact with a part of the inner circumferential surface 141*a* of the cylinder 141, the anodized coating layer formed on the outer circumferential surface of the piston 142 may be peeled off as the outer circumferential surface of the piston 142 is scratched by the sharp edges of the first gas pocket 1414*a*.

However, when the circumferential length of the first gas pocket 1414*a* is formed short as in this embodiment, an area at which the first gas pocket 1414*a* and the piston 142 are perpendicular to each other can be reduced, thereby suppressing peeling of the anodized coating layer of the piston 142. This can suppress abrasion of the edges of the first gas pocket 1414*a*, and therefore, the circumferential length of the first gas pocket 1414*a* may not be increased. Accordingly, a circumferential gap between the cylinder 141 and the piston 142 may not be increase to thereby suppress leakage of the refrigerant in the first gas pocket 1414*a* (see FIG. 10B).

Further, the first gas pocket 1414*a* can have a cross-sectional shape inclined in a depthwise direction of the cylinder 141, for example, a semi-rhombic shape. For example, the first gas pocket 1414*a* can have a cross-sectional shape inclined in the axial direction (or long axis direction) and the circumferential direction (or short axis direction) both, or can have a cross-sectional shape inclined either in the axial direction or the circumferential direction.

As described above, when the first gas pocket 1414*a* has a cross-sectional shape inclined in the depthwise direction, the first gas pocket 1414*a* can be easily fabricated compared to the cylinder depicted on FIG. 6 described above. In addition, in some implementations, based on constant maximum depth of the first gas pocket 1414*a*, damage to the anodized coating layer forming the outer circumferential surface 142*a* of the piston 142 can be more effectively suppressed by further increasing the edge angle $\alpha$ than a case where the first gas pocket 1414*a* has an elliptically curved shape in the depthwise direction. Further, the first gas pocket 1414*a* can have a rhombus shape in the radial direction.

Since the second gas pocket 1414*b* is defined in a shape same as the first gas pocket 1414*a*, a detailed description of the second gas pocket 1414*b* will be replaced with the description of the first gas pocket 1414*a*.

Hereinafter, description will be given for another gas pocket.

As described above, each of the first gas pocket and the second gas pocket has an elliptical shape when viewed in the radial direction, but in some cases, the first gas pocket and the second gas pocket each can have a rectangular shape. The first gas pocket and the second gas pocket can be defined in a shape (or a standard) same as each other or shapes different from each other. Hereinafter, a description will be given focusing on an example in which the first gas pocket and the second gas pocket are defined in a shape (or standard) same as each other, and the first gas pocket will be described as a representative example.

Figure 11:
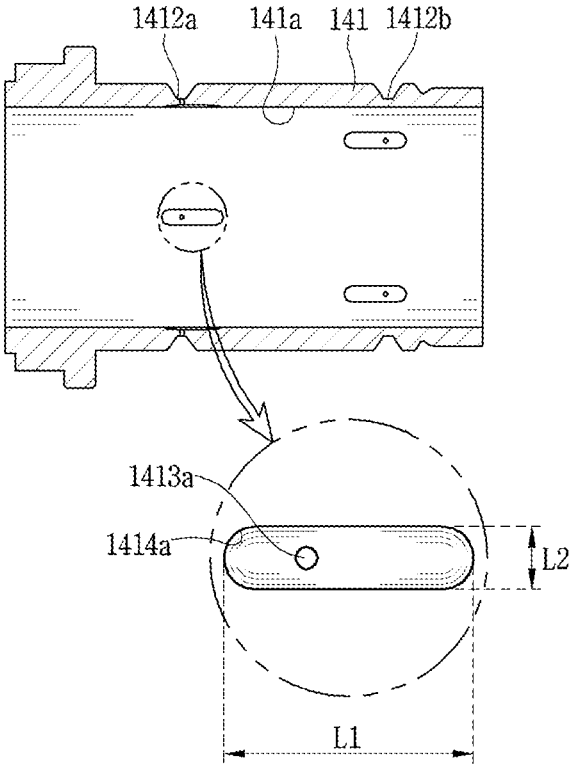
FIG. 11 is a diagram illustrating a sectional view of another cylinder.

FIG. 11 is a diagram illustrating a sectional view of another cylinder.

Referring to FIG. 11, the first gas pocket 1414*a* can be elongated in the lengthwise direction of the cylinder 141, that is, in the axial direction.

Specifically, when viewed in the radial direction, the axial length L1 of the first gas pocket 1414*a* can be longer than the circumferential length L2 of the first gas pocket 1414*a*. For example, when the first gas pocket 1414*a* is viewed from the central axis CL2 of the cylinder 141 in the radial direction, the first gas pocket 1414*a* can be defined in a rectangular shape with corners of the first gas pocket 1414*a* are rounded. The first gas pocket 1414*a* can be formed such that the lengthwise direction of the cylinder 141 forms a long axis of the first gas pocket 1414*a* and the circumferential direction of the cylinder 141 forms a short axis of the first gas pocket 1414*a*.

In some implementations, the first gas pocket 1414*a* can have an elliptically curved shape or inclined straight line shape in the depthwise direction. Since the shape of the first gas pocket 1414*a* is almost the same as that of the above-described implementations of the cylinder and the piston, an operation effect resulting therefrom is almost the same. Description thereof will be replaced by the description above.

Further, the first gas hole 1413*a* can be deviated from the center of the first gas pocket 1414*a* as described above. Description thereof will be replaced by the description above.

Further, the first gas pocket 1414*a* can have a rhombus shape when viewed in the radial direction. In some implementations, the first gas pocket 1414*a* can have a half rhombus shape or an elliptically curved shape in the depthwise direction.

As the second gas pocket 1414*b* is identical to the first gas pocket 1414*a*, a description thereof will be replaced with the description of the first gas pocket 1414*a*.

Hereinafter, description will be given for another gas pocket.

As described above, the first gas pocket and the second gas pocket are each defined in an elliptical shape or a rectangular shape with rounded corners when viewed in the radial direction, but in some cases, the first gas pocket and the second gas pocket each can be defined in a rectangular shape. In some implementations, the first gas pocket and the second gas pocket can be defined in a shape (or a standard) same as each other or shapes different from each other. Hereinafter, a description will be given focusing on an example in which the first gas pocket and the second gas pocket are defined in a shape (or standard) same as each other, and the first gas pocket will be described as a representative example.

Figure 12:
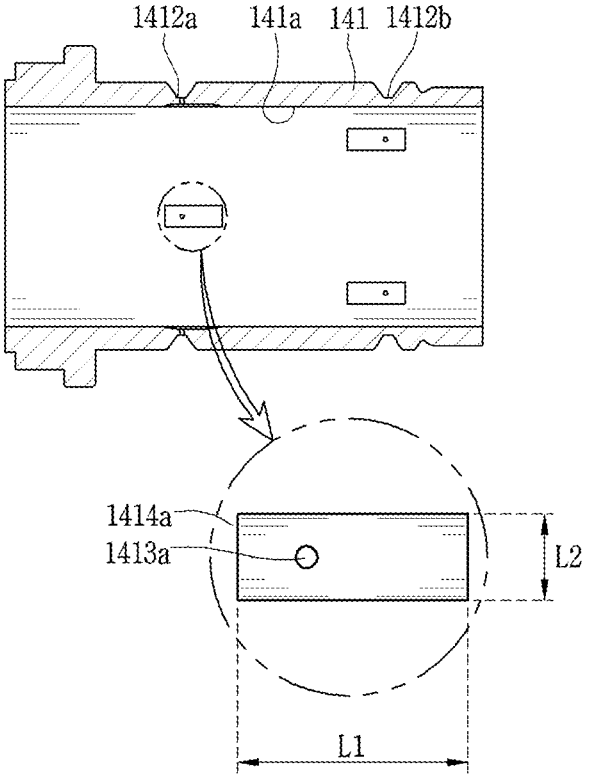
FIG. 12 is a diagram illustrating a sectional view of another cylinder.

FIG. 12 is a diagram illustrating a sectional view of another cylinder.

Referring to FIG. 12, the first gas pocket 1414*a* can be defined in an axially long rectangular shape. However, the first gas pocket 1414*a* may have an elliptically curved shape in the depthwise direction. Since the first gas pocket 1414*a* has an elliptically curved shape in the depthwise direction, which is the same as the first gas pocket 1414*a* described above, an operation effect resulting therefrom is the same.

For example, as the circumferential length L2 of the first gas pocket 1414*a* is shorter than the axial length L1 of the first gas pocket 1414*a*, a levitation force of the high-pressure gas flowing into the first gas pocket 1414*a* is increased while reducing an area orthogonal to a reciprocating direction of the piston 142, and this can suppress damage to the piston 142.

However, the first gas pocket 1414*a* may also have a rectangular cross-sectional shape in the depthwise direction. This can facilitate a fabrication process compared to the above-described implementations of FIGS. 6 and 11 in which the first gas pocket 1414*a* has an elliptically curved shape in the depthwise direction.

Further, the first gas hole 1413*a* can be deviated from the center of the first gas pocket 1414*a* as described above. Description thereof will be replaced by the implementations described above.

As the second gas pocket 1414*b* is identical to the first gas pocket 1414*a*, a description thereof will be replaced with the description of the first gas pocket 1414*a*.

Hereinafter, description will be given for another gas pocket.

As described above, the first gas pocket and the second gas pocket can be identical when viewed in the radial direction, but in some cases, the first gas pocket and the second gas pocket may be different.

Figure 13:
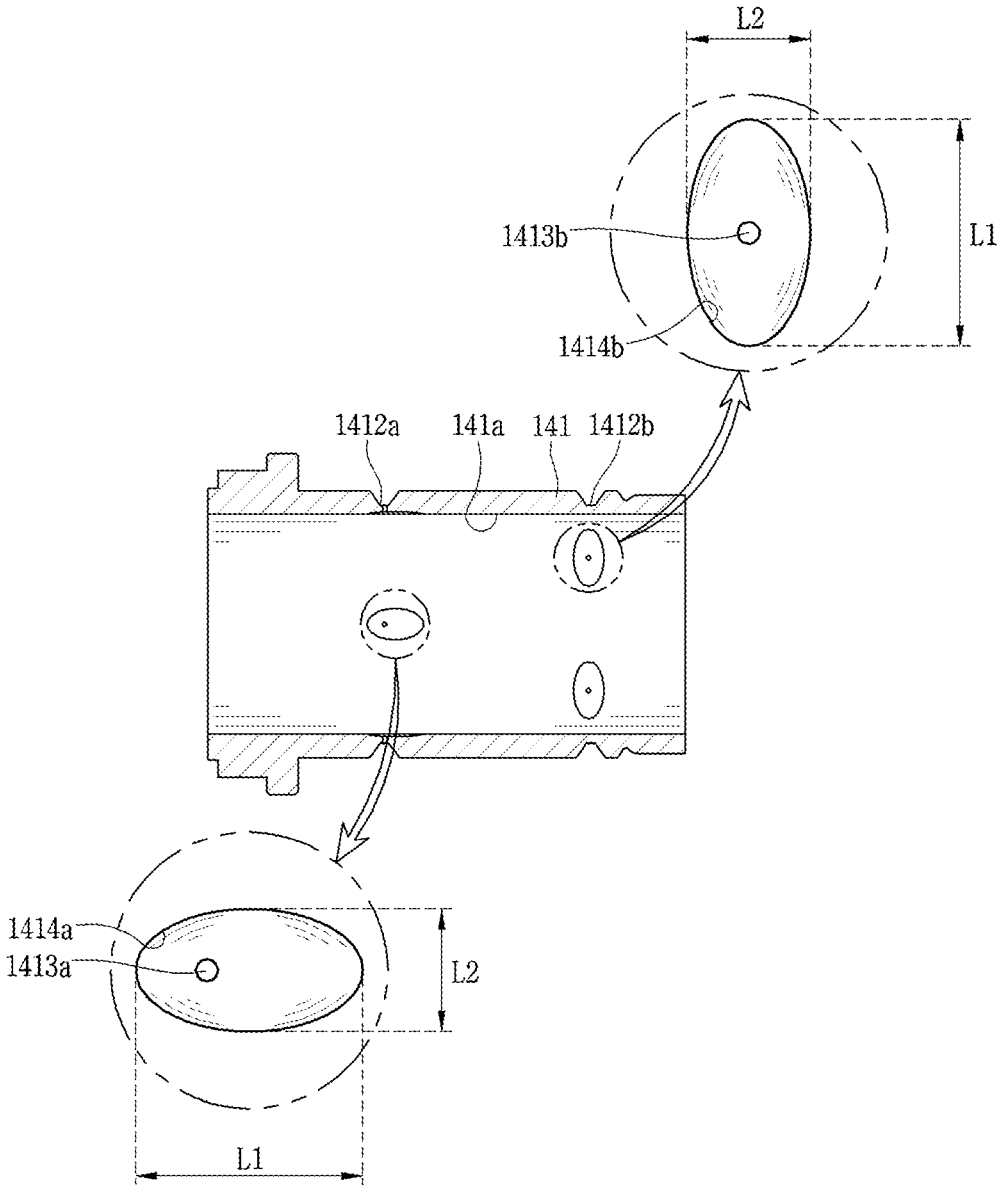
FIG. 13 is a diagram illustrating a sectional view of another cylinder.

FIG. 13 is a diagram illustrating a sectional view of another cylinder.

Referring to FIG. 13, the first gas pocket 1414*a* and the second gas pocket 1414*b* each can be elongated in a direction perpendicular to each other.

For example, the first gas pocket 1414*a* can be elongated in the axial direction and the second gas pocket 1414*b* can be elongated in the circumferential direction. In some implementations, the first gas pocket 1414*a* can be elongated in the circumferential direction, and the second gas pocket 1414*b* can be elongated in the axial direction.

However, as a rear side of the piston 142 is supported in a form of a cantilever by the resonance unit 160 as described above, the front side of the piston 142 can have a greater amount of sagging than the rear side of the piston 142. Accordingly, a front end of the piston 142 is tilted more than an angle at which a rear end of the piston 142 is tilted, and thus, the first gas pocket 1414*a* can be brought into closer contact with the outer circumferential surface of the piston 142 than the second gas pocket 1414*b* is, during the reciprocating motion of the piston 142.

Therefore, forming the circumferential length of the first gas pocket 1414*a* short may be advantageous in suppressing damage to the anodized coating layer formed on the outer circumferential surface of the piston 142 due to the edges between the first gas pocket 1414*a* and the cylinder 141.

For example, in a case where a long axis direction of the first gas pocket 1414*a* and a long axis direction of the second gas pocket 1414*b* are perpendicular to each other, damage to the outer circumferential surface of the piston 142 due to the edge of the gas pocket can be suppressed when the first gas pocket 1414*a* having a high possibility of contact with the piston 142 is elongated in the axial direction, and the second gas pocket 1414*b* is elongated in the circumferential direction.

Further, when the first gas pocket 1414*a* is elongated in the axial direction, leakage of the refrigerant from the first gas pocket 1414*a* into the compression space V during backward movement (or suction stroke) of the piston 142 is effectively suppressed while increasing a levitation force against the front end of the piston 142, to thereby reduce suction loss in the compression space V.

Referring back to FIGS. 9A and 9B, forming the gas pocket 1414 to be elongated in the axial direction can reduce the gap between the cylinder 141 and the piston 142, as described above. In particular, as the first gas pocket 1414*a* at the front side is adjacent to the compression space V in the linear compressor, refrigerant may leak from the first gas pocket 1414*a* into the compression space V during the suction stroke. This may increase a specific volume of the compression space V, and thereby causing suction loss.

With this reason, when the first gas pocket 1414*a* is elongated in the axial direction, the circumferential gap δ2 between the cylinder 141 and the piston 142 can be reduced, and therefore, leakage of refrigerant from the first gas pocket 1414*a* into the compression space V can be suppressed while increasing the levitation force against the front end of the piston 142. This can suppress an increase in the specific volume in the compression space V, thereby enhancing efficiency of the compressor.

However, when the second gas pocket 1414*b* is elongated in the circumferential direction on the inner circumferential surface 141*a* of the cylinder 141, the second gas hole 1413*b* communicated with the second gas pocket 1414*b* may be formed through the center of the second gas pocket 1414*b*. Accordingly, refrigerant flowing into the second gas pocket 1414*b* can be evenly distributed in the second gas pocket 1414*b*.

What is claimed is:

1. A linear compressor, comprising:

a piston configured to reciprocate in an axial direction; and a cylinder that is provided on a radially outer side of the piston to accommodate the piston and that defines a compression space with the piston, wherein the cylinder (i) is provided with a gas pocket that is recessed from an inner circumferential surface of the cylinder and that has an elliptical outline and (ii) defines a gas hole such that a first end of the gas hole is at an outer circumferential surface of the cylinder and a second end of the gas hole is at an inner circumferential surface of the cylinder, wherein the gas pocket comprises:

a first gas pocket provided at a first axial side of the cylinder with respect to a center of an axially extended line, and a second gas pocket provided at a second axial side of the cylinder with respect to the center of the axially extended line, wherein the first gas pocket and the second gas pocket are elongated in the axial direction of the cylinder, respectively, and wherein the gas hole comprises (i) a first gas hole deviated from a center of the first gas pocket toward a front end of the cylinder and (ii) a second gas hole deviated from a center of the second gas pocket toward a rear end of the cylinder.

2. The linear compressor of claim 1, wherein a depth of an inner circumferential surface of the gas pocket increases from an edge of the gas pocket to a central portion of the gas pocket.

3. The linear compressor of claim 1, wherein the gas pocket comprises a plurality of gas pockets that are spaced apart from each other at predetermined intervals in a circumferential direction of the cylinder, and wherein each of the plurality of gas pockets is in communication with a corresponding gas hole such that a first end of the corresponding gas hole is at an outer circumferential surface of the cylinder and a second end of the corresponding gas hole is at an inner circumferential surface of the cylinder.

* * * * *